US006474102B1

(12) United States Patent
Buerger

(10) Patent No.: US 6,474,102 B1
(45) Date of Patent: Nov. 5, 2002

(54) METHOD FOR DETERMINING A HIGH-REFLECTION CUT OF A GEM, METHOD FOR CUTTING A HIGH-REFLECTION GEM, AND THE CUT HIGH-REFLECTION GEM

(76) Inventor: Helmut Buerger, Max-von-Laue-Strasse 6/VIII, Munich D-80937 (DE)

( * ) Notice: Subject to any disclaimer, the term of this patent is extended or adjusted under 35 U.S.C. 154(b) by 0 days.

(21) Appl. No.: 09/463,418

(22) PCT Filed: Jul. 30, 1998

(86) PCT No.: PCT/EP98/04772

§ 371 (c)(1),
(2), (4) Date: Feb. 4, 2000

(87) PCT Pub. No.: WO99/07244

PCT Pub. Date: Feb. 18, 1999

(30) Foreign Application Priority Data

Aug. 6, 1997 (DE) ..... 197 34 036

(51) Int. Cl.[7] ..... A44C 17/00
(52) U.S. Cl. ..... 63/32
(58) Field of Search ..... 63/32

(56) References Cited

U.S. PATENT DOCUMENTS

| | | | | | |
|---|---|---|---|---|---|
| 2,364,031 | A | * | 11/1944 | Suderov | 63/32 |
| 4,083,352 | A | | 4/1978 | Andrychuk | 63/32 |
| 4,708,001 | A | | 11/1987 | Alburger | 63/32 |
| 5,454,235 | A | * | 10/1995 | Freiesleben | 63/32 |
| 5,657,646 | A | * | 8/1997 | Rosenberg | 63/32 |
| 5,657,647 | A | * | 8/1997 | Freiesleben | 63/32 |
| 5,970,744 | A | * | 10/1999 | Greeff | 63/32 |
| 6,029,474 | A | * | 2/2000 | Bunz | 63/32 |
| 6,158,243 | A | * | 12/2000 | Couture | 63/32 |
| 6,305,193 | B1 | * | 10/2001 | Cheng | 63/32 |

FOREIGN PATENT DOCUMENTS

| | | |
|---|---|---|
| CH | 684301 | 8/1994 |
| DE | 1 557 652 | 4/1970 |
| DE | 24 06 008 | 8/1975 |
| DE | 42 10 995 | 10/1993 |
| GB | 2 292 668 | 3/1996 |

* cited by examiner

*Primary Examiner*—J. J. Swann
*Assistant Examiner*—Andrea Chop
(74) *Attorney, Agent, or Firm*—Jacobson Holman PLLC

(57) ABSTRACT

The invention relates to a method for determining a high-reflection cut of a gem, a method for cutting a high-reflection gem, and a cut high-reflection gem. According to the invention, the gems have at least three lower part main facets and at least three upper part main facets, the angle between the lower part main facets and the girdle plane being greater than the angle between the upper part main facets and the girdle plane. A table replaces the upper part main facets at an angle of 0°. The lower part main facet angle is between 41° and 46° and the upper part main facet angle corresponds to an angle from a group of predetermined preferred angles. The group of angles is determined according to the average refraction of light n (between 1.50 and 3.00) of the raw material being cut and the lower part main facet angle.

28 Claims, 15 Drawing Sheets for principal pavilion facet angle 41° principal crown facet angle in ° for principal pavilion facet angle 44° principal crown facet angle in ° for principal pavilion facet angle 46° principal crown facet angle in °

Principal crown facet angle in °

Principal crown facet angle in °

Principal crown facet angle in °

METHOD FOR DETERMINING A HIGH-REFLECTION CUT OF A GEM, METHOD FOR CUTTING A HIGH-REFLECTION GEM, AND THE CUT HIGH-REFLECTION GEM

BACKGROUND OF THE INVENTION

1. Field of the Invention

The invention relates to a procedure for determining a high-reflection gem cut, procedure for cutting a high-reflection gem, and a cut gem of high reflection.

2. Description of the Related Art

The reflection or light efficiency of a gem cut essentially depends on the dimension and number of facets and on the angles created by them. Many trials have been carried out in the past for improving gem cuts used in practice or for creating new gem cuts. These trials are based, on the one hand, on empirical cutting trials, or [on the other hand] on simple calculations which also take into account the optical refraction of the raw material to be cut.

For example, DE-AS 1 557 652 specifies combinations of upper part (crown) principal facet angles and lower part (pavilion) principal facet angles for various types of minerals, for example 27°/36° for diamonds, 25°/49° for quartz, 24°/45° for tourmaline, 29°/38° for garnet, 28°/39° for beryl, and 28°/39° for corundum.

All these angle combinations have in common the fact that the lower part (pavilion) principal facet angle is larger than the upper part (crown) principal facet angle.

Such cuts, especially for diamonds, with angle combinations of 24.5°/39.5°, or of 33.5°/41.5° are also known from DE 42 10 995 A1.

It has been proved in practice that the angle combinations mentioned in the literature for gem cutting do not yet produce maximum light efficiency, and that a systematic specification of optimal angle combinations is very desirable for all materials to be cut, which have different optical refraction.

SUMMARY OF THE INVENTION

Therefore, the objective of the invention is to specify a procedure for determining a gem cut, a procedure for gem cutting and a cut gem, whereby optimal light efficiency should be achieved when applying the specified angle values, while talking into consideration the light refraction of the material to be cut.

This objective is solved by a cut gem with characteristics including high reflection with at least three principal pavilion facets and at least three principal crown facets, the angle between the principal pavilion facets and the girdle surface being greater than the angle between the principal crown facets and the girdle surface. At angle 0° a table is formed instead of the principal crown facets, with principal pavilion facet angle (UHFW) ranging between 41° and 46°. Principal crown facet angle (OHFW) corresponds to an angle selected from a group of predetermined, preferred angles, which are subject to mean optical refraction n ranging between 1.50 and 3.00 of the raw material to be cut, and principal pavilion facet angle (UHFW). The group of predetermined, preferred angles includes the following angles:

at n 1.50 and UHFW of 42°⇒angles of 13° to 33°
at n 1.50 and UHFW of 43°⇒angles of 60° to 26°
at n 1.50 and UHFW of 44°⇒angles of 1° to 18°
at n 1.50 and UHFW of 45°⇒angles of 0° to 9°
at n 1.50 and UHFW of 46°⇒angles of 0° at n 1.55 and UHFW of 41°⇒angles of 18° to 33°
at n 1.55 and UHFW of 42°⇒angles of 12° to 30°
at n 1.55 and UHFW of 43°⇒angles of 6° to 26°
at n 1.55 and UHFW of 44°⇒angles of 1° to 18°
at n 1.55 and UHFW of 45°⇒angles of 0° to 13°
at n 1.55 and UHFW of 46°⇒angles of 0° to 5°
at n 1.60 and UHFW of 41°⇒angles of 17° to 31°
at n 1.60 and UHFW of 42°⇒angles of 11° to 28°
at n 1.60 and UHFW of 43°⇒angles of 6° to 23°
at n 1.60 and UHFW of 44°⇒angles of 1° to 20°
at n 1.60 and UHFW of 45°⇒angles of 0° to 14°
at n 1.60 and UHFW of 46°⇒angles of 0° to 6°
at n 1.65 and UHFW of 41°⇒angles of 16° to 28°
at n 1.65 and UHFW of 42°⇒angles of 11° to 25°
at n 1.65 and UHFW of 43°⇒angles of 5° to 21°
at n 1.65 and UHFW of 44°⇒angles of 1to 17°
at n 1.65 and UHFW of 45°⇒angles of 0° to 14°
at n 1.65 and UHFW of 46°⇒angles of 0° to 6°
at n 1.70 and UHFW of 41°⇒angles of 15° to 27°
at n 1.70 and UHFW of 42°⇒angles of 10° to 23°
at n 1.70 and UHFW of 43°⇒angles of 5° to 20°
at n 1.70 and UHFW of 44°⇒angles of 1° to 17°
at n 1.70 and UHFW of 45°⇒angles of 0° to 12°
at n 1.70 and UHFW of 46°⇒angles of 0° to 6°
at n 1.75 and UHFW of 41°⇒angles of 15° to 25°
at n 1.75 and UHFW of 42°⇒angles of 10° to 22°
at n 1.75 and UHFW of 43°⇒angles of 5° to 19°
at n 1.75 and UHFW of 44°⇒angles of 1° to 15°
at n 1.75 and UHFW of 45°⇒angles of 0° to 12°
at n 1.75 and UHFW of 46°⇒angles of 0° to 3°
at n 1.80 and UHFW of 41°⇒angles of 14° to 24°
at n 1.80 and UHFW of 42°⇒angles of 10° to 21°
at n 1.80 and UHFW of 43°⇒angles of 5° to 19°
at n 1.80 and UHFW of 44°⇒angles of 1° to 14°
at n 1.80 and UHFW of 45°⇒angles of 0°0 to 11°
at n 1.80 and UHFW of 46°⇒angles of 0° to 3°
at n 1.85 and UHFW of 41°⇒angles of 14° to 23°
at n 1.85 and UHFW of 42°⇒angles of 9° to 20°
at n 1.85 and UHFW of 43°⇒angles of 5° to 17°
at n 1.85 and UHFW of 44°⇒angles of 1° to 14°
at n 1.85 and UHFW of 45°⇒angles of 0° to 11°
at n 1.85 and UHFW of 46°⇒angles of 0° to 3°
at n 1.90 and UHFW of 41°⇒angles of 14° to 22°
at n 1.90 and UHFW of 42°⇒angles of 9° to 20°
at n 1.90 and UHFW of 43°⇒angles of 5° to 17°
at n 1.90 and UHFW of 44°⇒angles of 1° to 14°
at n 1.90 and UHFW of 45°⇒angles of 0° to 9°
at n 1.90 and UHFW of 46°⇒angles of 0° to 3°
at n 1.95 and UHFW of 46°⇒angles of 13° to 22°
at n 1.95 and UHFW of 42°⇒angles of 9° to 20°
at n 1.95 and UHFW of 43°⇒angles of 5° to 16°
at n 1.95 and UHFW of 44°⇒angles of 1° to 13°
at n 1.95 and UHFW of 45°⇒angles of 0° to 9°
at n 1.95 and UHFW of 46°⇒angles of 0° to 3°
at n 2.00 and UHFW of 41°⇒angles of 13° to 22°
at n 2.00 and UHFW of 42°⇒angles of 8° to 17°
at n 2.00 and UHFW of 43°⇒angles of 4° to 16°
at n 2.00 and UHFW of 44°⇒angles of 1° to 12°
at n 2.00 and UHFW of 45°⇒angles of 0° to 9°
at n 2.00 and UHFW of 46°⇒angles of 0° to 3°
at n 2.05 and UHFW of 41°⇒angles of 13° to 19°
at n 2.05 and UHFW of 42°⇒angles of 8° to 16°
at n 2.05 and UHFW of 43°⇒angles of 4° to 14°
at n 2.05 and UHFW of 44°⇒angles of 1° to 12°
at n 2.05 and UHFW of 45°⇒angles of 0° to 9°
at n 2.05 and UHFW of 46°⇒angles of 0° to 3°
at n 2.10 and UHFW of 41°⇒angles of 12° to 19° at n 2.10 and UHFW of 42°⇒angles of 8° to 16°
at n 2.10 and UHFW of 43°⇒angles of 4° to 14°
at n 2.10 and UHFW of 44°⇒angles of 1° to 12°
at n 2.10 and UHFW of 45°⇒angles of 0° to 8°
at n 2.10 and UHFW of 46°⇒angles of 0° to 3°
at n 2.15 and UHFW of 41°⇒angles of 12° to 18°
at n 2.15 and UHFW of 42°⇒angles of 8° to 16°
at n 2.15 and UHFW of 43°⇒angles of 4° to 14°
at n 2.15 and UHFW of 44°⇒angles of 1° to 11°
at n 2.15 and UHEW of 45°⇒angles of 0° to 8°
at n 2.15 and UHEW of 46°⇒angles of 0° to 4°
at n 2.15 and UHFW of 41°⇒angles of 12° to 17°
at n 2.20 and UHFW of 42°⇒angles of 8° to 15°
at n 2.20 and UHFW of 43°⇒angles of 4° to 13°
at n 2.20 and UHFW of 44°⇒angles of 1° to 10°
at n 2.20 and UHFW of 45°⇒angles of 0° to 8°
at n 2.20 and UHFW of 46°⇒angles of 0° to 4°
at n 2.20 and UHFW of 41°⇒angles of 12° to 17°
at n 2.25 and UHFW of 42°⇒angles of 8° to 15°
at n 2.25 and UHFW of 43°⇒angles of 4° to 13°
at n 2.25 and UHFW of 44°⇒angles of 1° to 10°
at n 2.25 and UHFW of 45°⇒angles of 0° to 8°
at n 2.25 and UHFW of 46°⇒angles of 0° to 3°
at n 2.30 and UHFW of 41°⇒angles of 12° to 17°
at n 2.30 and UHFW of 42°⇒angles of 7° to 15°
at n 2.30 and UHFW of 43°⇒angles of 4° to 13°
at n 2.30 and UHFW of 44°⇒angles of 1° to 10°
at n 2.30 and UHFW of 45°⇒angles of 0° to 7°
at n 2.30 and UHFW of 46°⇒angles of 0° to 3°
at n 2.35 and UHFW of 41°⇒angles of 11° to 17°
at n 2.35 and UHFW of 42°⇒angles of 7° to 14°
at n 2.35 and UHFW of 43°⇒angles of 4° to 12°
at n 2.35 and UHFW of 44°⇒angles of 1° to 10°
at n 2.35 and UHFW of 45°⇒angles of 0° to 7°
at n 2.35 and UHFW of 46°⇒angles of 0° to 3°
at n 2.40 and UHFW of 41°⇒angles of 11° to 16°
at n 2.40 and UHFW of 42°⇒angles of 7° to 14°
at n 2.40 and UHFW of 43°⇒angles of 4° to 12°
at n 2.40 and UHFW of 44°⇒angles of 1° to 10°
at n 2.40 and UHFW of 45°⇒angles of 0° to 7°
at n 2.40 and UHFW of 46°⇒angles of 0° to 3°
at n 2.45 and UHFW of 41°⇒angles of 11° to 16°
at n 2.45 and UHEW of 42°⇒angles of 7° to 14°
at n 2.45 and UHFW of 43°⇒angles of 4° to 12°
at n 2.45 and UHFW of 44°⇒angles of 1° to 1°
at n 2.45 and UHFW of 45°⇒angles of 0° to 7°
at n 2.45 and UHFW of 46°⇒angles of 0° to 3°
at n 2.50 and UHFW of 41°⇒angles of 11° to 16°
at n 2.50 and UHFW of 42°⇒angles of 7° to 14°
at n 2.50 and UHFW of 43°⇒angles of 4° to 11°
at n 2.50 and UHFW of 44°⇒angles of 1° to 9°
at n 2.50 and UHFW of 45°⇒angles of 0° to 7°
at n 2.50 and UHFW of 46°⇒angles of 0° to 3°
at n 2.55 and UHFW of 41°⇒angles of 11° to 15°
at n 2.55 and UHFW of 42°⇒angles of 7° to 13°
at n 2.55 and UHFW of 43°⇒angles of 4° to 11°
at n 2.55 and UHFW of 44°⇒angles of 1° to 9°
at n 2.55 and UHFW of 45°⇒angles of 0° to 7°
at n 2.55 and UHFW of 46°⇒angles of 0° to 2°
at n 2.60 and UHFW of 41°⇒angles of 11° to 15°
at n 2.60 and UHFW of 42°⇒angles of 7° to 13°
at n 2.60 and UHFW of 43°⇒angles of 4° to 11°
at n 2.60 and UHFW of 44°⇒angles of 1° to 9°
at n 2.60 and UHFW of 45°⇒angles of 0° to 7°
at n 2.60 and UHFW of 46°⇒angles of 0° to 2°
at n 2.65 and UHFW of 41°⇒angles of 10° to 15°
at n 2.65 and UHFW of 42°⇒angles of 7° to 13°
at n 2.65 and UHFW of 43°⇒angles of 4° to 11°
at n 2.65 and UHFW of 44°⇒angles of 1° to 9°
at n 2.65 and UHFW of 45°⇒angles of 0° to 6°
at n 2.65 and UHFW of 46°⇒angles of 0° to 2°
at n 2.70 and UHFW of 41°⇒angles of 10° to 15°
at n 2.70 and UHFW of 42°⇒angles of 7° to 13°
at n 2.70 and UHFW of 43°⇒angles of 4° to 11°
at n 2.70 and UHFW of 44°⇒angles of 1° to 9°
at n 2.70 and UHFW of 45°⇒angles of 0° to 6°
at n 2.70 and UHFW of 46°⇒angles of 0° to 2°
at n 2.75 and UHFW of 41°⇒angles of 10° to 15°
at n 2.75 and UHFW of 42°⇒angles of 7° to 12°
at n 2.75 and UHFW of 43°⇒angles of 4° to 11°
at n 2.75 and UHFW of 44°⇒angles of 1° to 9°
at n 2.75 and UHFW of 45°⇒angles of 0° to 6°
at n 2.75 and UHFW of 46°⇒angles of 0° to 1°
at n 2.80 and UHFW of 41°⇒angles of 10° to 15°
at n 2.80 and UHFW of 42°⇒angles of 7° to 12°
at n 2.80 and UHFW of 43°⇒angles of 4° to 10°
at n 2.80 and UHFW of 44°⇒angles of 1° to 8°
at n 2.80 and UHFW of 45°⇒angles of 0° to 6°
at n 2.80 and UHFW of 46°⇒angles of 0° to 1°
at n 2.85 and UHFW of 41°⇒angles of 10° to 14°
at n 2.85 and UHFW of 42°⇒angles of 7° to 12°
at n 2.85 and UHFW of 43°⇒angles of 4° to 10°
at n 2.85 and UHFW of 44°⇒angles of 1° to 8°
at n 2.85 and UHFW of 45°⇒angles of 0° to 6°
at n 2.85 and UHFW of 46°⇒angles of 0° to 1°
at n 2.90 and UHFW of 41°⇒angles of 10° to 14°
at n 2.90 and UHFW of 42°⇒angles of 7° to 12°
at n 2.90 and UHFW of 43°⇒angles of 4° to 10°
at n 2.90 and UHFW of 44°⇒angles of 1° to 8°
at n 2.90 and UHFW of 45°⇒angles of 0° to 6°
at n 2.90 and UHFW of 46°⇒angles of 0° to 1°
at n 2.95 and UHFW of 41°⇒angles of 10° to 14°
at n 2.95 and UHFW of 42°⇒angles of 7° to 12°
at n 2.95 and UHFW of 43°⇒angles of 4° to 10°
at n 2.95 and UHFW of 44°⇒angles of 10° to 8°
at n 2.95 and UHFW of 45°⇒angles of 0° to 6°
at n 2.95 and UHFW of 46°⇒angles of 0° to 1°
at n 3.00 and UHFW of 41°⇒angles of 10° to 14°
at n 3.00 and UHFW of 42°⇒angles of 7° to 12°
at n 3.00 and UHFW of 43°⇒angles of 4° to 10°
at n 3.00 and UHFW of 44°⇒angles of 1° to 8°
at n 3.00 and UHFW of 45°⇒angles of 0° to 6°
at n 3.00 and UHFW of 46°⇒angles of 0° to 1°

Principal crown facet angles (OHFW) for values of n and principal pavilion facet angles (UHFW) not specifically specified above may be interpolated from the above specified values. Within the group of angles just specified, a group of especially preferred angles includes:

at n 1.50 and UHFW of 42°⇒angles of 16° to to 25°
at n 1.50 and UHFW of 43°⇒angles of 10° to 21°
at n 1.50 and UHFW of 44°⇒angles of 3° to 16°
at n 1.50 and UHFW of 45°⇒angles of 0° to 9°
at n 1.55 and UHFW of 41°⇒angles of 20° to 26°
at n 1.55 and UHFW of 42°⇒angles of 15° to 23°
at n 1.55 and UHFW of 43°⇒angles of 9° to 19°
at n 1.55 and UHFW of 44°⇒angles of 3° to 16°
at n 1.55 and UHFW of 45°⇒angles of 0° to 8°
at n 1.60 and UHFW of 41°⇒angles of 19° to 25°
at n 1.60 and UHFW of 42°⇒angles of 14° to 21°
at n 1.60 and UHFW of 43°⇒angles of 8° to 17°
at n 1.60 and UHFW of 44°⇒angles of 2° to 12°
at n 1.60 and UHFW of 45°⇒angles of 0° to 7°
at n 1.60 and UHFW of 46°⇒angles of 0°
at n 1.65 and UHFW of 41°⇒angles of 19° to 23° at n 1.65 and UHFW of 42°⇒angles of 13° to 20°
at n 1.65 and UHFW of 43°⇒angles of 8° to 15°
at n 1.65 and UHFW of 44°⇒angles of 2° to 11°
at n 1.65 and UHFW of 45°⇒angles of 0° to 6°
at n 1.65 and UHFW of 46°⇒angles of 0°
at n 1.70 and UHFW of 41°⇒angles of 18° ° 0 to 21°
at n 1.70 and UHFW of 42°⇒angles of 120 to 18°
at n 1.70 and UHFW of 43°⇒angles of 70 to 14°
at n 1.70 and UHFW of 44°⇒angles of 2° to 11°
at n 1.70 and UHFW of 45°⇒angles of 0° to 6°
at n 1.70 and UHFW of 46°⇒angles of 0°
at n 1.75 and UHFW of 41°⇒angles of 170 to 21°
at n 1.75 and UHFW of 42°⇒angles of 120 to 16°
at n 1.75 and UHFW of 43°⇒angles of 70 to 13°
at n 1.75 and UHFW of 44°⇒angles of 20 to 11°
at n 1.75 and UHFW of 45°⇒angles of 0° to 6°
at n 1.75 and UHFW of 46°⇒angles of 0° to 1°
at n 1.80 and UHFW of 41°⇒angles of 160 to 19°
at n 1.80 and UHFW of 42°⇒angles of 120 to 16°
at n 1.80 and UHFW of 43°⇒angles of 70 to 13°
at n 1.80 and UHFW of 44°⇒angles of 20 to 10°
at n 1.80 and UHFW of 45°⇒angles of 0° to 6°
at n 1.80 and UHFW of 46°⇒angles of 0° to 1°
at n 1.85 and UHFW of 41°⇒angles of 16° to 18°
at n 1.85 and UHFW of 42°⇒angles of 110 to 15°
at n 1.85 and UHFW of 43°⇒angles of 60 to 12°
at n 1.85 and UHFW of 44°⇒angles of 20 to 10°
at n 1.85 and UHFW of 45°⇒angles of 0° to 6°
at n 1.85 and UHFW of 46°⇒angles of 0°
at n 1.90 and UHFW of 41°⇒angles of 160 to 18°
at n 1.90 and UHFW of 42°⇒angles of 110 to 14°
at n 1.90 and UHFW of 43°⇒angles of 60 to 12°
at n 1.90 and UHFW of 44°⇒angles of 20 to 9°
at n 1.90 and UHFW of 45°⇒angles of 0° to 6°
at n 1.90 and UHFW of 46°⇒angles of 0°
at n 1.95 and UHFW of 41°⇒angles of 15° to 17°
at n 1.95 and UHFW of 42°⇒angles of 11° to 14°
at n 1.95 and UHFW of 43°⇒angles of 6° to 12°
at n 1.95 and UHFW of 44°⇒angles of 2° to 9°
at n 1.95 and UHFW of 45°⇒angles of 0° to 6°
at n 1.95 and UHFW of 46°⇒angles of 0°
at n 2.00 and UHFW of 41°⇒angles of 15° to 17°
at n 2.00 and UHFW of 42°⇒angles of 10° to 14°
at n 2.00 and UHFW of 43°⇒angles of 6° to 12°
at n 2.00 and UHFW of 44°⇒angles of 2° to 9°
at n 2.00 and UHFW of 45°⇒angles of 0° to 6°
at n 2.00 and UHFW of 46°⇒angles of 0°
at n 2.05 and UHFW of 41°⇒angles of 15° to 17°
at n 2.05 and UHFW of 42°⇒angles of 10° to 14°
at n 2.05 and UHFW of 43°⇒angles of 6° to 11°
at n 2.05 and UHFW of 44°⇒angles of 2° to 9°
at n 2.05 and UHFW of 45°⇒angles of 0° to 6°
at n 2.05 and UHFW of 46°⇒angles of 0°
at n 2.10 and UHFW of 41°⇒angles of 14° to 16°
at n 2.10 and UHFW of 41°⇒angles of 10° to 14°
at n 2.10 and UHFW of 43°⇒angles of 6° to 11°
at n 2.10 and UHFW of 44°⇒angles of 2° to 9°
at n 2.10 and UHFW of 45°⇒angles of 0° to 6°
at n 2.10 and UHFW of 46°⇒angles of 0°
at n 2.15 and UHFW of 41°⇒angles of 14° to 16°
at n 2.15 and UHFW of 42°⇒angles of 10° to 13°
at n 2.15 and UHFW of 43°⇒angles of 5° to 11°
at n 2.15 and UHFW of 44°⇒angles of 2° to 9°
at n 2.15 and UHFW of 45°⇒angles of 0° to 6°
at n 2.15 and UHFW of 46°⇒angles of 0°
at n 2.20 and UHFW of 46°⇒angles of 14° to 15°
at n 2.20 and UHFW of 42°⇒angles of 10° to 13°
at n 2.20 and UHFW of 43°⇒angles of 5° to 11°
at n 2.20 and UHFW of 44°⇒angles of 2° to 8°
at n 2.20 and UHFW of 45°⇒angles of 0° to 5°
at n 2.20 and UHFW of 46°⇒angles of 0°
at n 2.25 and UHFW of 41°⇒angles of 14° to 15°
at n 2.25 and UHFW of 42°⇒angles of 10° to 13°
at n 2.25 and UHFW of 43°⇒angles of 5° to 11°
at n 2.25 and UHFW of 44°⇒angles of 2° to 8°
at n 2.25 and UHFW of 45°⇒angles of 0° to 5°
at n 2.25 and UHFW of 46°⇒angles of 0°
at n 2.30 and UHFW of 41°⇒angles of 14° to 15°
at n 2.30 and UHFW of 42°⇒angles of 9° to 13°
at n 2.30 and UHFW of 43°⇒angles of 5° to 10°
at n 2.30 and UHFW of 44°⇒angles of 2° to 8°
at n 2.30 and UHFW of 45°⇒angles of 0° to 5°
at n 2.30 and UHFW of 46°⇒angles of 0°
at n 2.35 and UHFW of 41°⇒angles of 13° to 15°
at n 2.35 and UHFW of 42°⇒angles of 9° to 12°
at n 2.35 and UHFW of 43°⇒angles of 5° to 10°
at n 2.35 and UHFW of 44°⇒angles of 2° to 7°
at n 2.35 and UHFW of 45°⇒angles of 0° to 5°
at n 2.35 and UHFW of 46°⇒angles of 0°
at n 2.40 and UHFW of 41°⇒angles of 13° to 14°
at n 2.40 and UHFW of 42°⇒angles of 9° to 12°
at n 2.40 and UHFW of 43°⇒angles of 5° to 9°
at n 2.40 and UHFW of 44°⇒angles of 2° to 7°
at n 2.40 and UHFW of 45°⇒angles of 0° to 4°
at n 2.40 and UHFW of 46°⇒angles of 0°
at n 2.45 and UHFW of 41°⇒angles of 13° to 14°
at n 2.45 and UHFW of 42°⇒angles of 9° to 11°
at n 2.45 and UHFW of 43°⇒angles of 5° to 9°
at n 2.45 and UHFW of 44°⇒angles of 2° to 7°
at n 2.45 and UHFW of 45°⇒angles of 0° to 4°
at n 2.45 and UHFW of 46°⇒angles of 0°
at n 2.50 and UHFW of 41°⇒angles of 13°
at n 2.50 and UHFW of 42°⇒angles of 9° to 11°
at n 2.50 and UHFW of 43°⇒angles of 5° to 9°
at n 2.50 and UHFW of 44°⇒angles of 2° to 7°
at n 2.50 and UHFW of 45°⇒angles of 0° to 4°
at n 2.55 and UHFW of 41°⇒angles of 13°
at n 2.55 and UHFW of 42°⇒angles of 9° to 11°
at n 2.55 and UHFW of 43°⇒angles of 5° to 9°
at n 2.55 and UHFW of 44°⇒angles of 2° to 7°
at n 2.55 and UHFW of 45°⇒angles of 0° to 3°
at n 2.60 and UHFW of 41°⇒angles of 13°
at n 2.60 and UHFW of 42°⇒angles of 9° to 11°
at n 2.60 and UHFW of 43°⇒angles of 5° to 9°
at n 2.60 and UHFW of 44°⇒angles of 2° to 7°
at n 2.60 and UHFW of 45°⇒angles of 0° to 3°
at n 2.65 and UHFW of 42°⇒angles of 9° to 11°
at n 2.65 and UHFW of 43°⇒angles of 5° to 9°
at n 2.65 and UHFW of 44°⇒angles of 2° to 6°
at n 2.65 and UHFW of 45°⇒angles of 0° to 3°
at n 2.70 and UHFW of 42°⇒angles of 9° to 10°
at n 2.70 and UHFW of 43°⇒angles of 5° to 9°
at n 2.70 and UHFW of 44°⇒angles of 2° to 6°
at n 2.70 and UHFW of 45°⇒angles of 0° to 3°
at n 2.75 and UHFW of 42°⇒angles of 9° to 10°
at n 2.75 and UHFW of 43°⇒angles of 5° to 8°
at n 2.75 and UHFW of 44°⇒angles of 2° to 6°
at n 2.75 and UHFW of 45°⇒angles of 0° to 3°
at n 2.80 and UHFW of 42°⇒angles of 9° to 10°
at n 2.80 and UHFW of 43°⇒angles of 5° to 8°
at n 2.80 and UHFW of 44°⇒angles of 2° to 6°
at n 2.80 and UHFW of 45°⇒angles of 0° to 3°
at n 2.85 and UHFW of 42°⇒angles of 9°
at n 2.85 and UHFW of 43°⇒angles of 5° to 8° at n 2.85 and UHFW of 44°⇒angles of 2° to 6°
at n 2.85 and UHFW of 45°⇒angles of 0° to 3°
at n 2.90 and UHFW of 42°⇒angles of 9°
at n 2.90 and UHFW of 43°⇒angles of 5° to 8°
at n 2.90 and UHFW of 44°⇒angles of 2° to 6°
at n 2.90 and UHFW of 45°⇒angles of 0° to 3°
at n 2.95 and UHFW of 42°⇒angles of 8° to 9°
at n 2.95 and UHFW of 43°⇒angles of 5° to 8°
at n 2.95 and UHFW of 44°⇒angles of 2° to 6°
at n 2.95 and UHFW of 45°⇒angles of 0° to 3°
at n 3.00 and UHFW of 42°⇒angles of 8° to 9°
at n 3.00 and UHFW of 43°⇒angles of 5° to 8°
at n 3.00 and UHFW of 44°⇒angles of 2° to 6°
at n 3.00 and UHFW of 45°⇒angles of 0° to 3°

Principal crown facet angles (OHFW) for values of n and principal pavilion facet angles (UHFW) not specifically specified above may be interpolated from the above specified values.

According to additional embodiments the cut gem may further include a number of principal crown facets, the stone having a table of a diameter which preferably amounts to 0 to 85% of the diameter of the girdle surface.

For a diamond, the group of preferred principal crown facet angles (OHFW) according to an embodiment of the present invention comprises the following angles:

with UHFW of 41°⇒angles of 11° to
with UHFW of 42°⇒angles of 7° to 14°
with UHFW of 43°⇒angles of 4° to 12°
with UHFW of 44°⇒angles of 1° to 10°
with UHFW of 45°⇒angles of 0° to 7°
with UHFW of 46°⇒angles of 0° to 3°

According to another embodiment of the invention, within the group of preferred angles from which the principal crown facet angle is selected is a group of especially preferred principal crown facet angles (OHFW) which comprises the following angles:

with UHFW of 41°⇒angles of 13° to 14°
with UHFW of 42°⇒angles of 9° to 12°
with UHFW of 43°⇒angles of 5° to 9°
with UHFW of 44°⇒angles of 2° to 7°
with UHFW of 45°⇒angles of 0° to 4°
with UHFW of 46°⇒angles of 0°

The raw material used for cutting the cut gem may be either a natural stone or synthetic material.

In addition to principal pavilion facets (UHFW) and principal crown facets (OHFW), the gem stone may include additional dependent pavilion facets and/or dependent crown facets. According to such embodiment, the principal crown facets may have an angle selected from the group of especially preferred principal crown facet angles (OHFW) and the dependent crown facets may have an angle selected from the group of preferred angles.

The number of pavilion facets and/or and the number of crown facets may be an even or an odd number. According to one preferred embodiment, the number of pavilion facets and/or the number of crown facets is greater than 13.

Furthermore the edges between the principal pavilion facets and the principal crown facets may be mutually offset on the girdle surface. The girdle surface may be of any shape, and may be either formed as an edge between the pavilion facets and the crown facets, or consist of one or several rounded or flat facets of any height. The gem stone according to the invention may be either manually or automatically cut.

By systematic cutting trials and by systematically calculating the reflection (light efficiency) as a function of the preselected cut angle, while simulating various lighting conditions, it has been established that optimal reflection may only be realized within a narrow range of 41° to 46° of the lower part (pavilion) principal facet angle. As a function of a lower part (pavilion) principal facet angle, and of a mean optical refraction of the raw material to be cut between n 1.50 and 3.00, a relatively limited number of angles resulting in a high degree of reflection for the cut gems is produced for the upper part (crown) principal facets. This angle range is described as the preferred angle range. The greatest light efficiency results from a generally smaller range of especially preferred angles.

A high-reflection gem cut can therefore be determined for an available natural or synthetic uncut gem, so as to result in optimal utilization of the existing raw material. Determining the cut may be done without further technical auxiliary materials, simply by following the specified technical theory. However, it is also possible to determine for the available uncut gem a computer-controlled cut of optimal light efficiency. Thus, the dimensions of an uncut gem, for example, can be optically measured by an already known computer-controlled system. Adjusting a cut to the required dimensions is also part of the state of the art. If, on the basis of the invention, the preferred or especially preferred angle combination and the light refraction of the material to be processed are entered into the computer program of the automatic machine, it becomes automatically possible to achieve a high reflection cut and optimal material utilization (weight).

Cutting the gem with the values determined in this way may be implemented manually or automatically, and even without further manual handling of the stone after it was optically measured. According to the present state of the art, such automatic measuring and cutting machines are commercially available.

With natural raw material, a finished gem with facets may naturally only be obtained by a cutting procedure. For synthetic material, such as glass, additional alternatives are available, such as molding, pressing forming, etc., which are considered equivalent to the cutting a procedure applicable to natural material.

If, in the aforementioned system, high light efficiency occurs when a group of upper part (crown) principal facet angles enclose an angle of 0°, then instead of a minimum of three principal crown facets at an angle of 0°, one table is produced. Thus, practically speaking, at an angle of 0° several principal crown facets merge into one table. If the principal crown facet angle differs from 0°, then an additional table may be present. Supplementary to the principal crown facets and the principal pavilion facets, additional dependent facets may exist, resulting in especially high light efficiency when the principal crown facets are within the range of especially preferred angles, and the dependent crown facets are within the range of preferred angles.

Gems can be cut with an even and/or odd number of principal crown facets or principal pavilion facets, whereby the number of principal crown facets is equal to, or differs from the number of principal pavilion facets. An especially high light efficiency results from any even or odd number of facets which is greater than 13.

The edges of the principal crown facets and those of the principal pavilion facets may abut on the girdle surface; the surfaces, however, may also be mutually offset.

The girdle surface may have any shape and may, for example, be round, oval, square, or rectangular. The girdle may be made in the form of an edge located between the facets of the pavilion and the facets of the crown; however, it also may consist of one or more rounded or flat surfaces of any chosen height.

In case of cuts with several crown facets and/or a few pavilion facets, usually the principal facets are larger than the various dependent facets. Additional examples and definitions can be derived from the embodiment examples.

BRIEF DESCRIPTION OF THE DRAWINGS

The invention is explained below by means of the drawings showing.

DETAILED DESCRIPTION OF THE PREFERRED EMBODIMENTS

FIGS. 1 to 9 show groups of preferred (light gray) and especially preferred (dark gray) principal crown facet angles (OHFW) dependent on optical refraction n of the material to be cut and on principal pavilion facet angle (UHFW); these specific values can also be taken from Table 1. For not explicitly specified values n and unspecified principal pavilion facet angles, i.e. for interim values between integers 41° to 46°, an expert can easily interpolate preferred and especially preferred principal crown facet angles.

Figure 1:
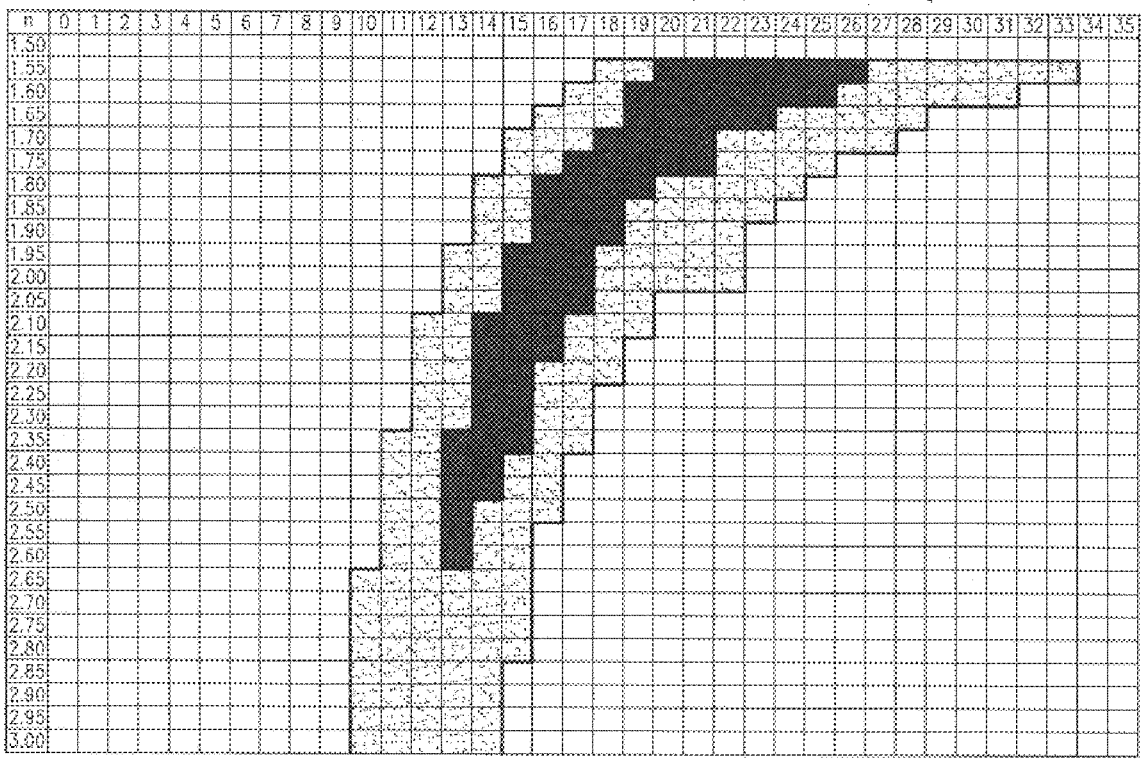
FIGS. 1 to 6 graphic presentation of preferred and especially preferred principal crown facet angles as a function of optical refraction for various principal pavilion facet angles ranging from 41° to 46°.
Figure 2:
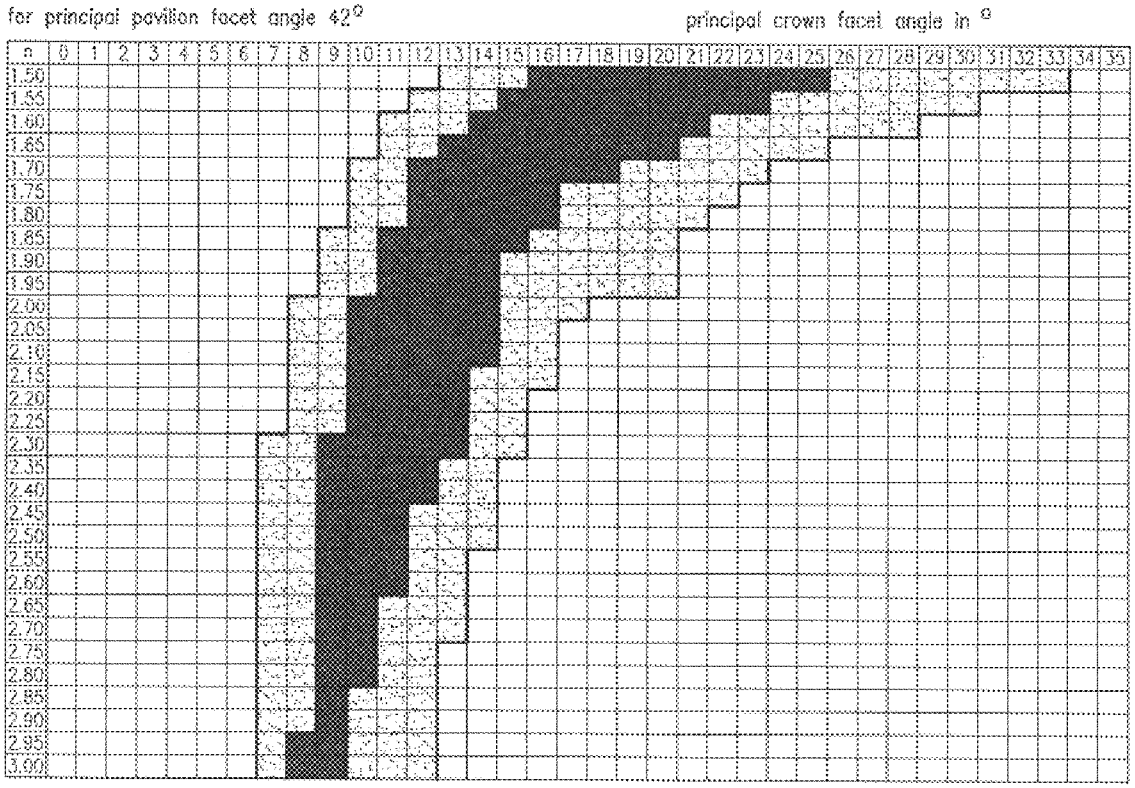
Figure 3:
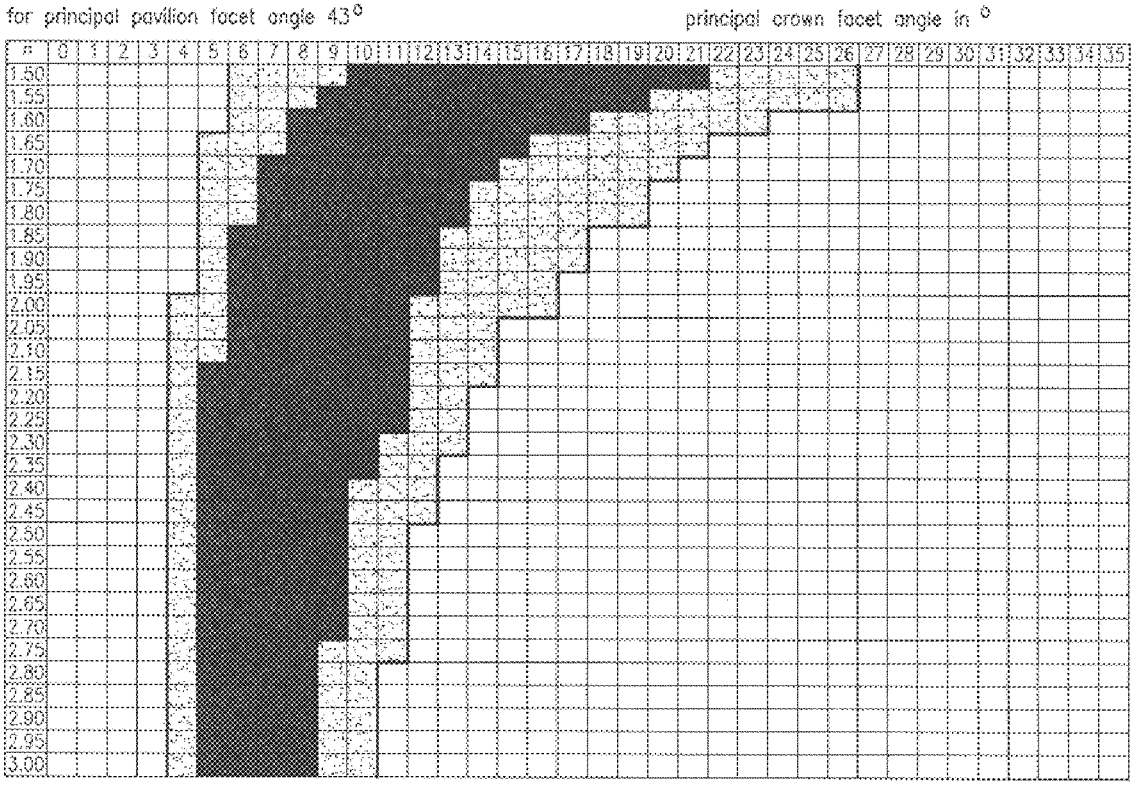
Figure 4:
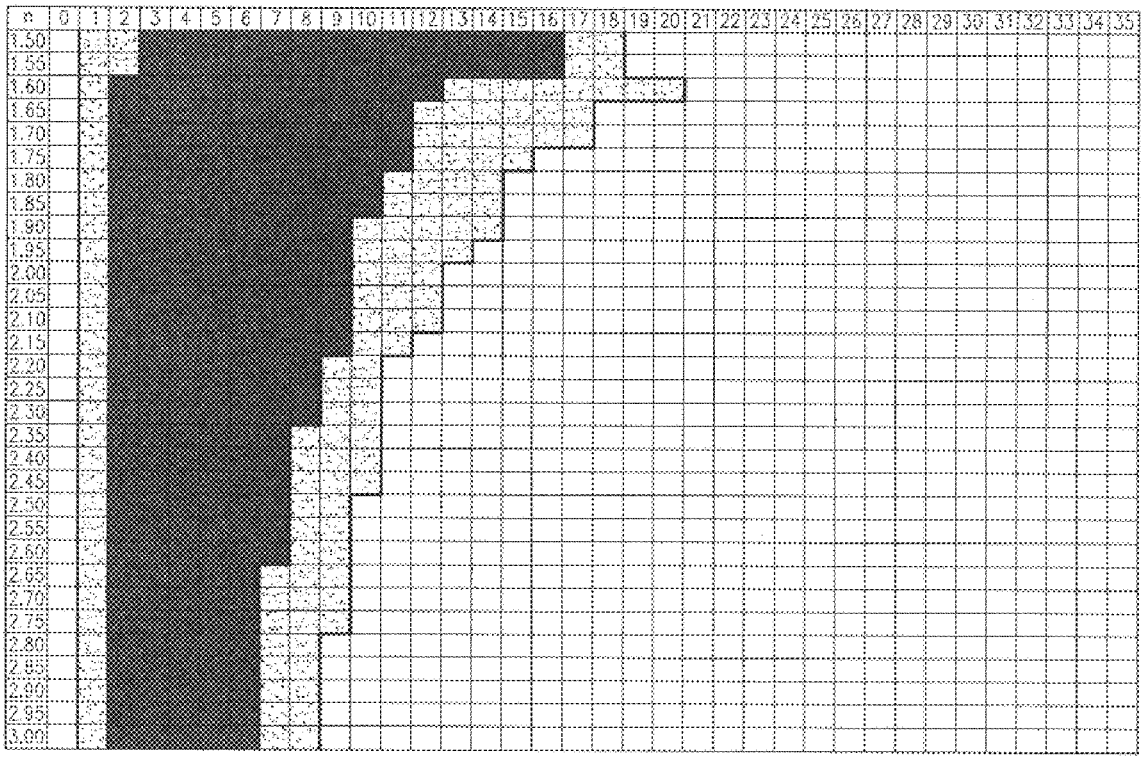
Figure 5:
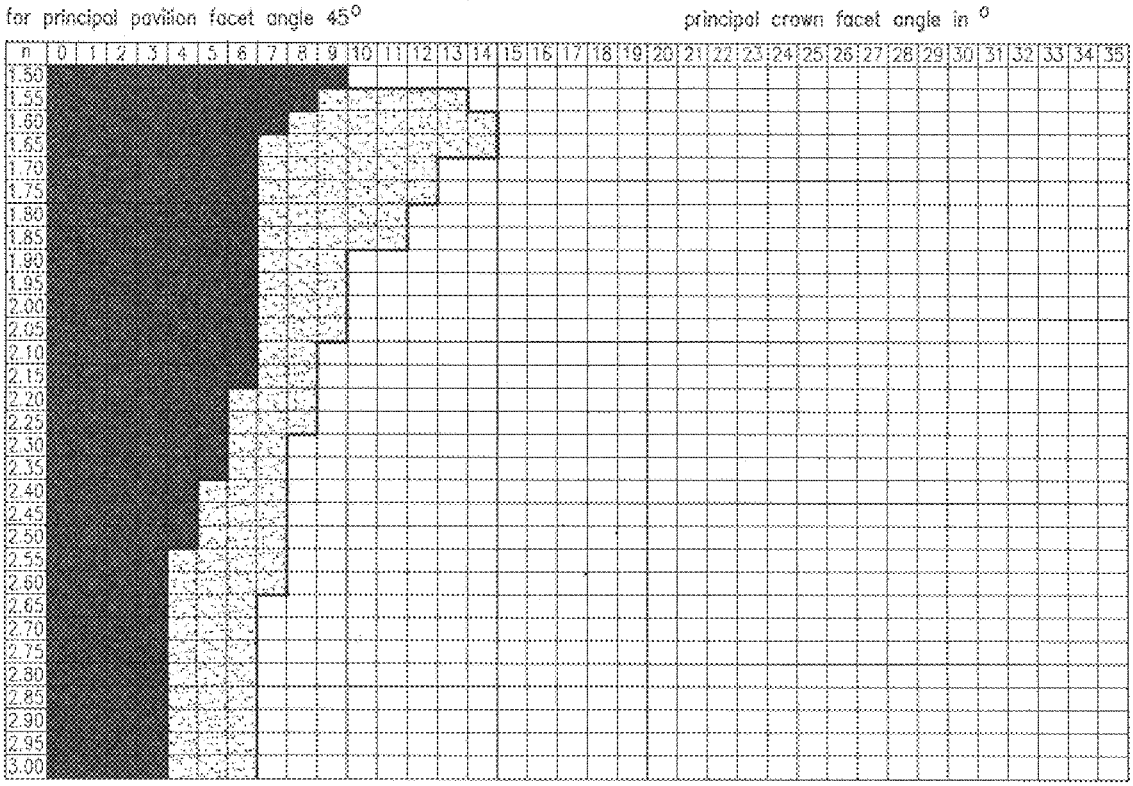
Figure 6:
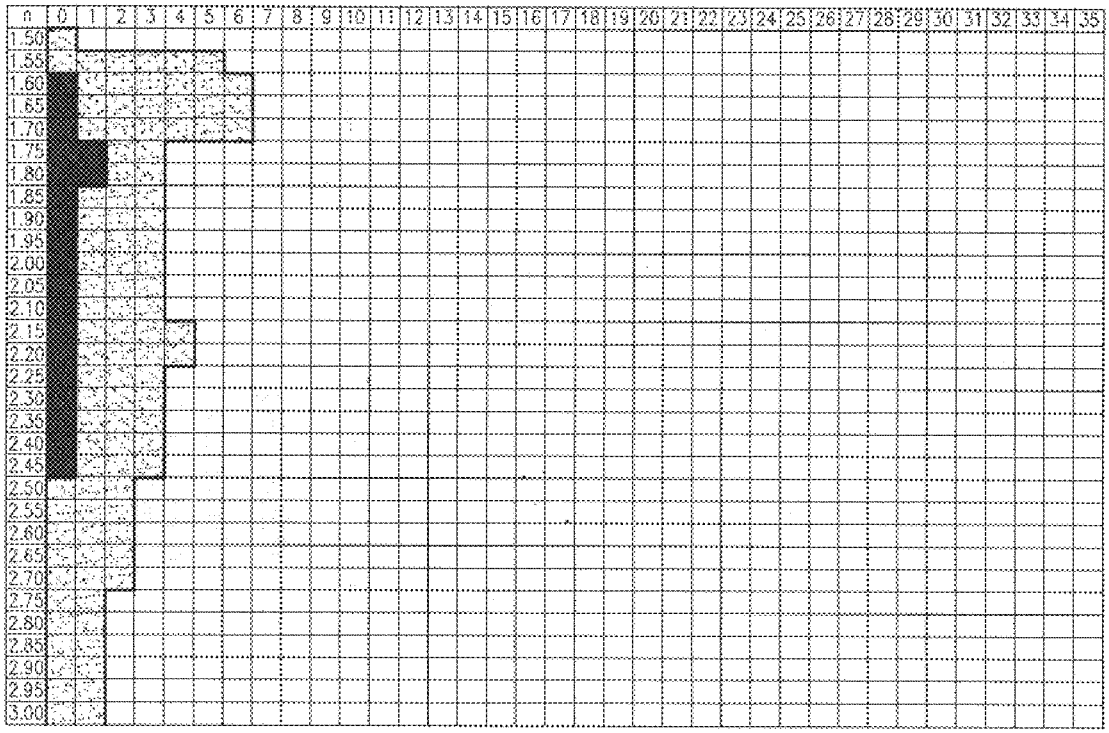
Figure 7:
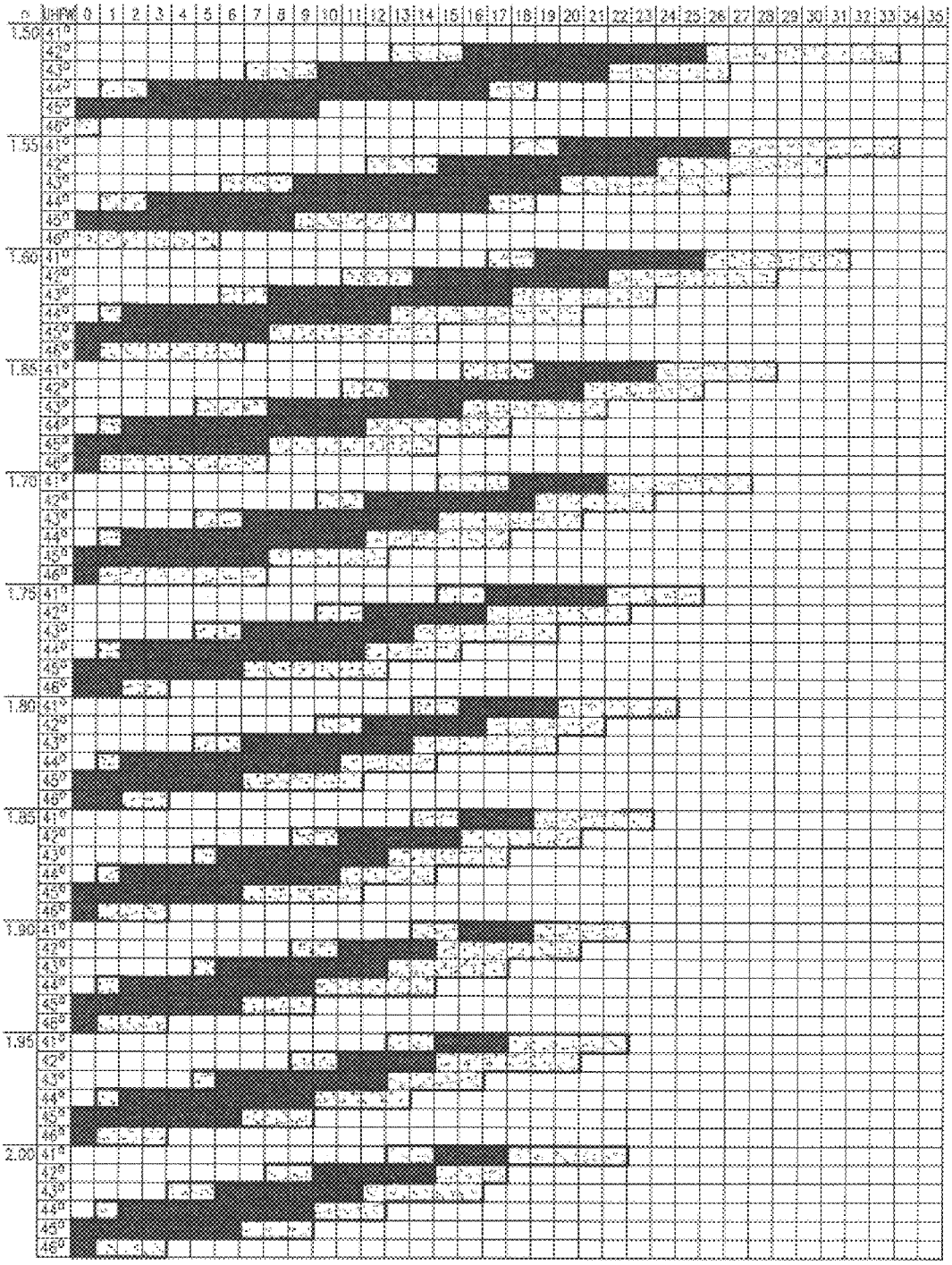
FIGS. 7 to 9 graphic presentation of preferred and especially preferred principal crown facet angles as a function of principal pavilion facet angles for various optical refraction values ranging from 1.50 to 3.00.
Figure 8:
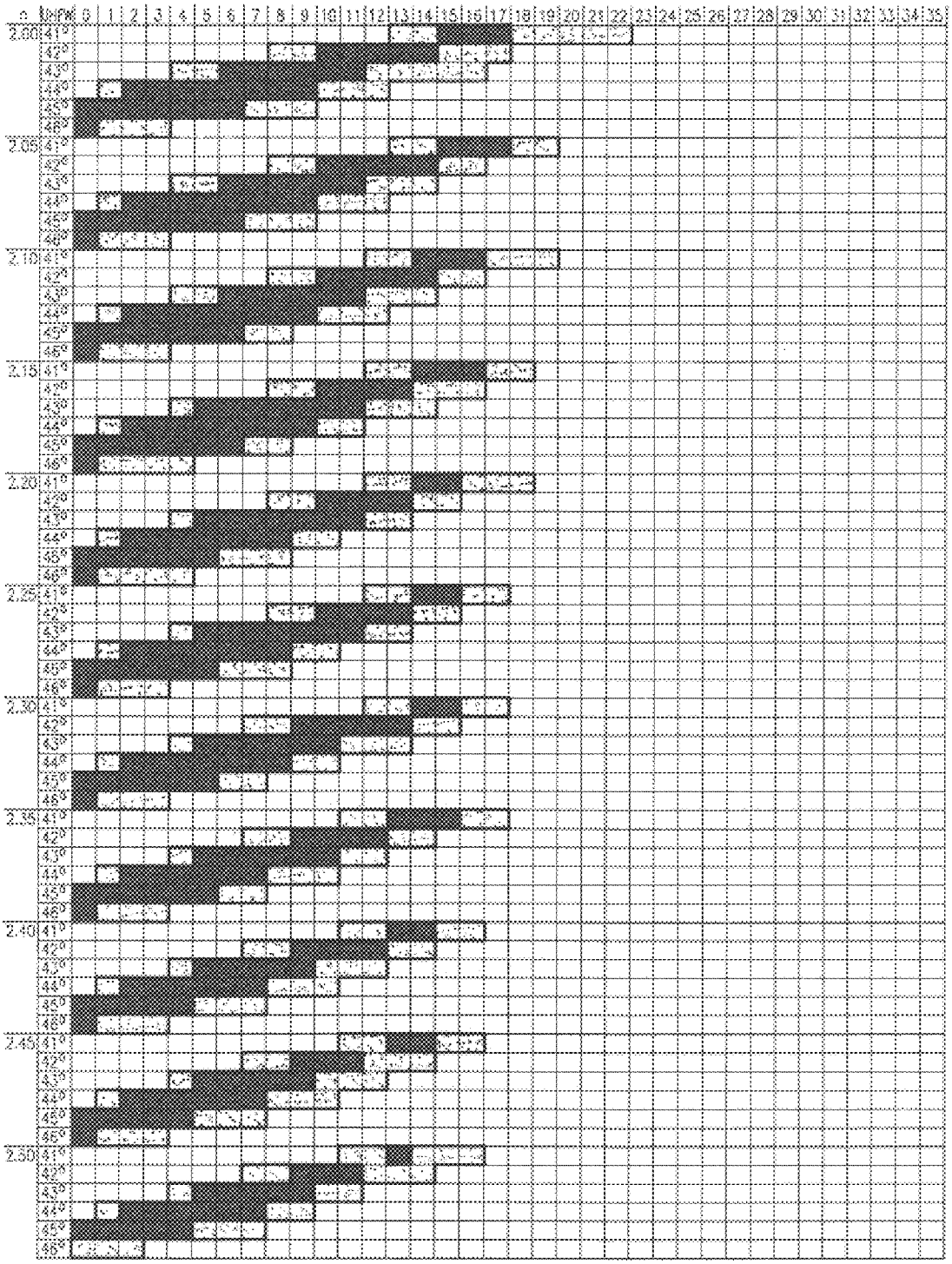
Figure 9:
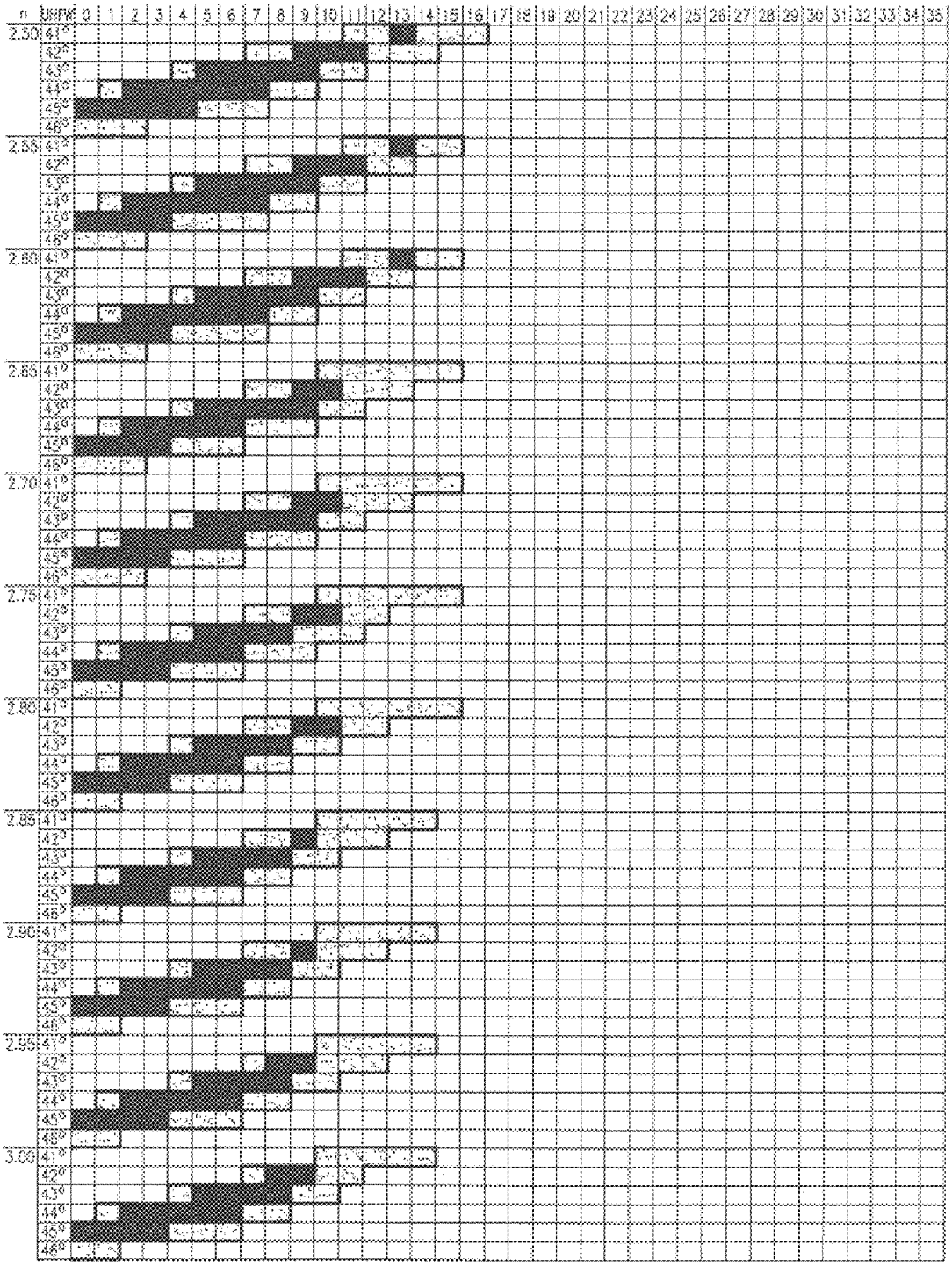
Figure 10A:
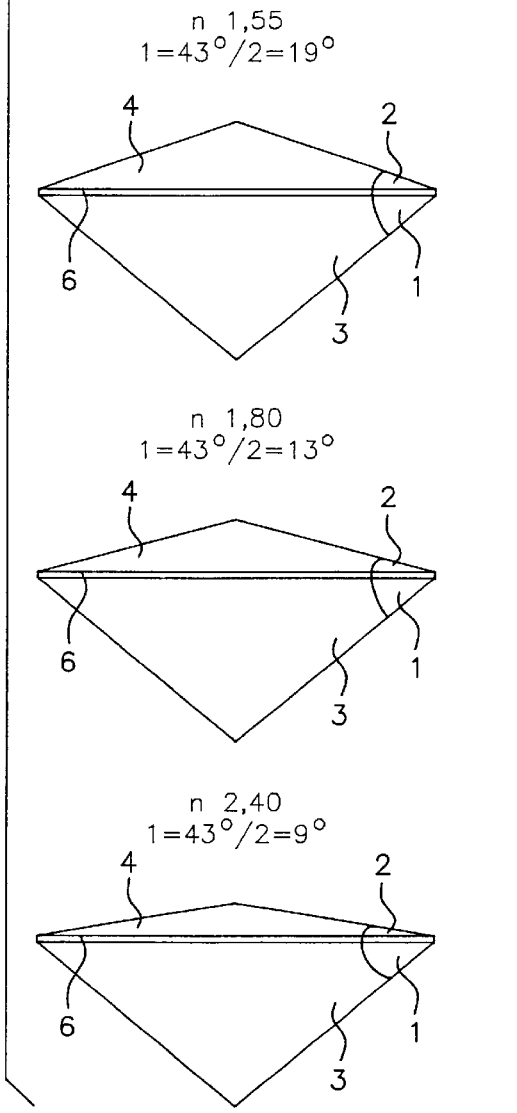
FIGS. 10 to 13 schematic cross sections through cut gems viewed parallel to the girdle surface.
Figure 10B:
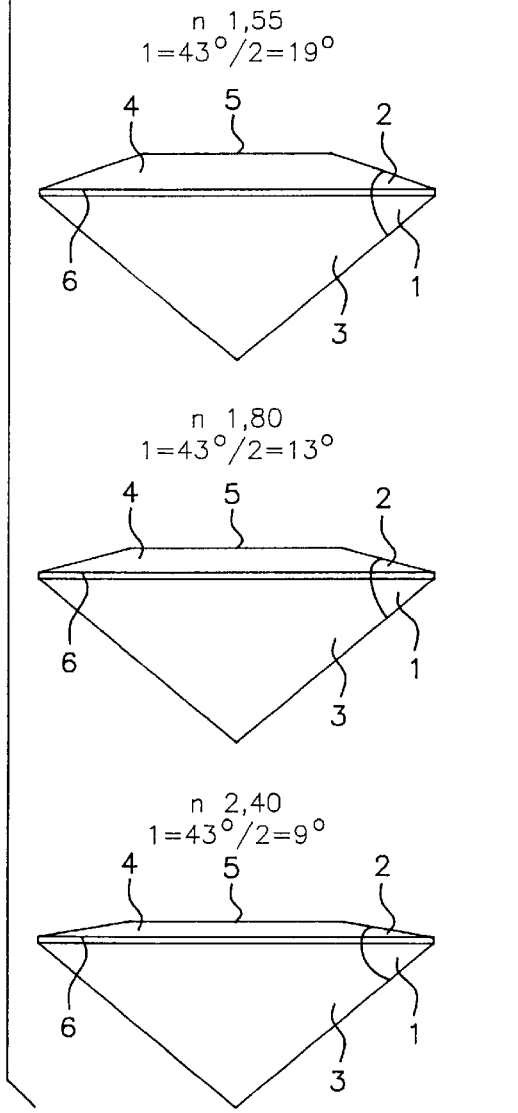
Figure 10C:
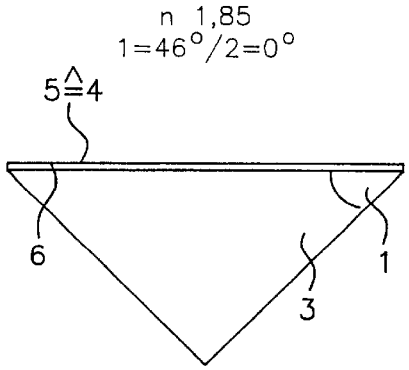
Figure 11A:
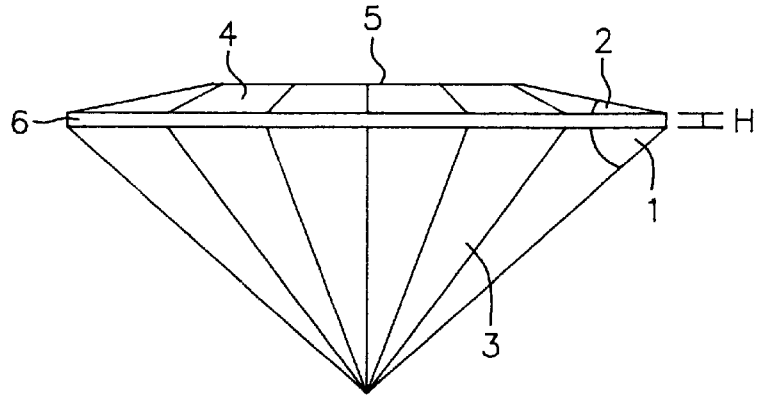
Figure 11B:
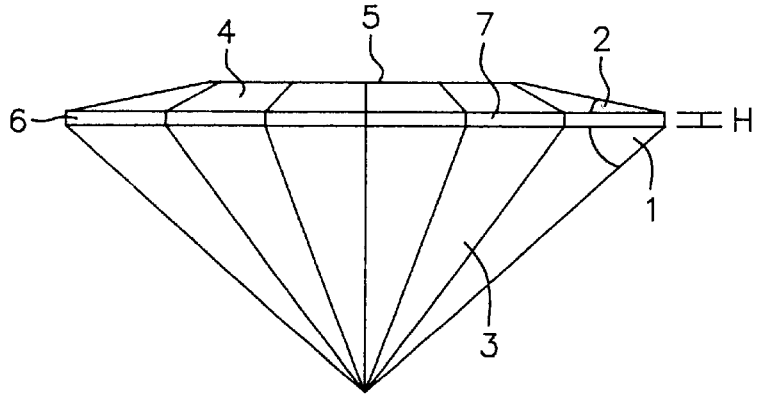
Figure 11C:
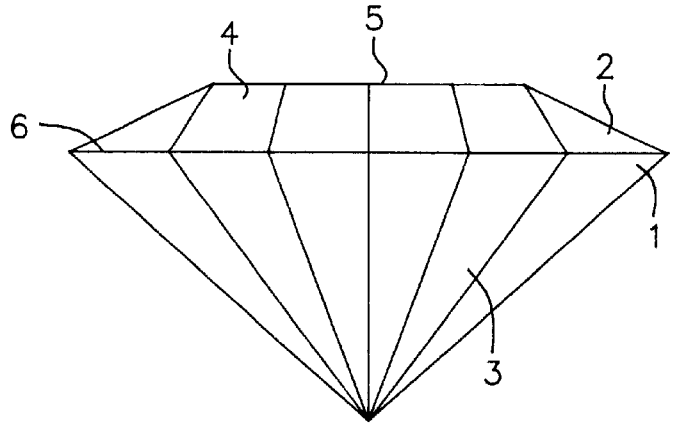
Figure 11D:
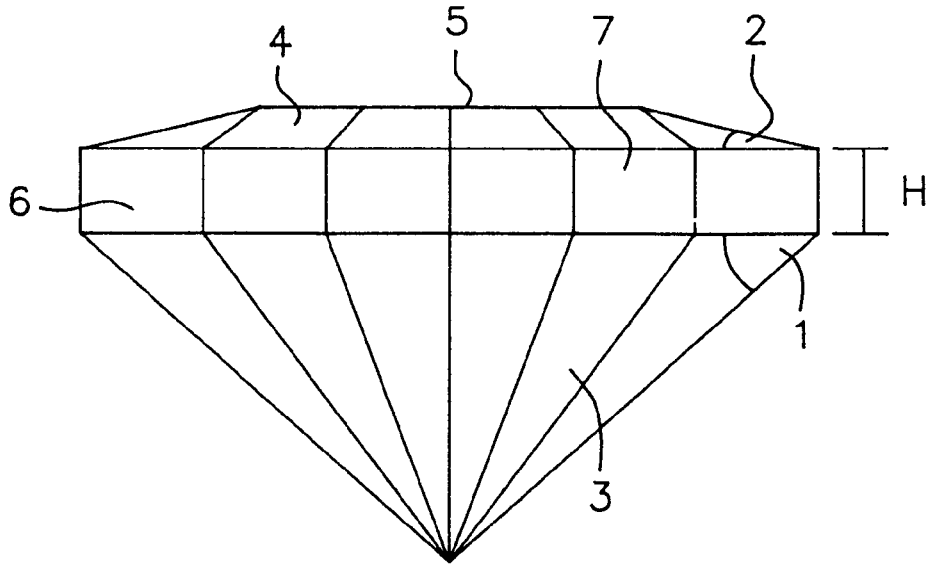
Figure 11E:
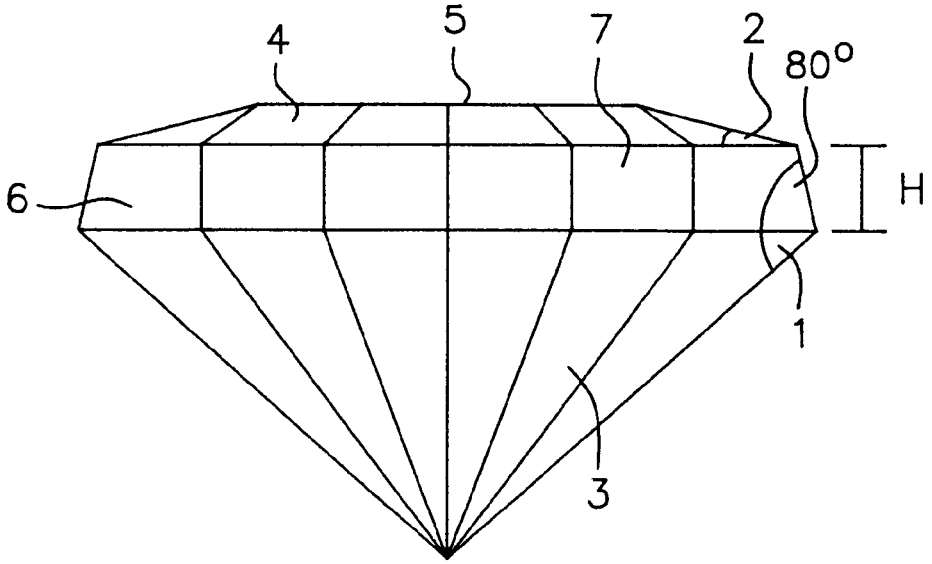
Figure 12A:
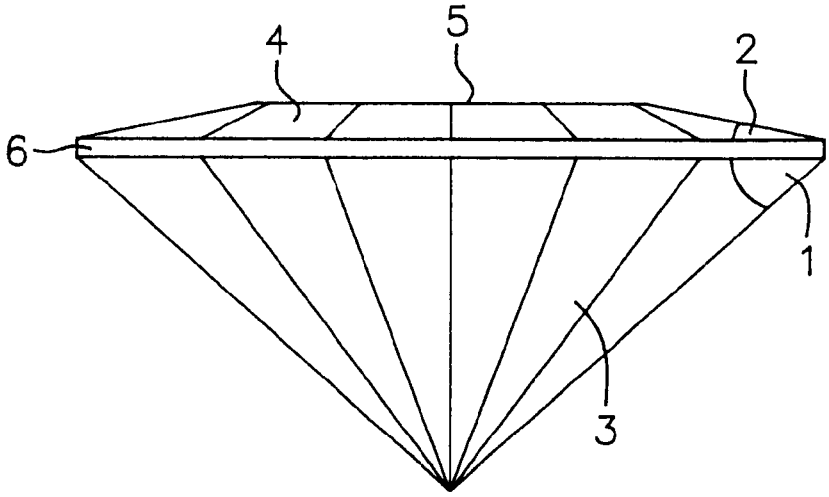
Figure 12B:
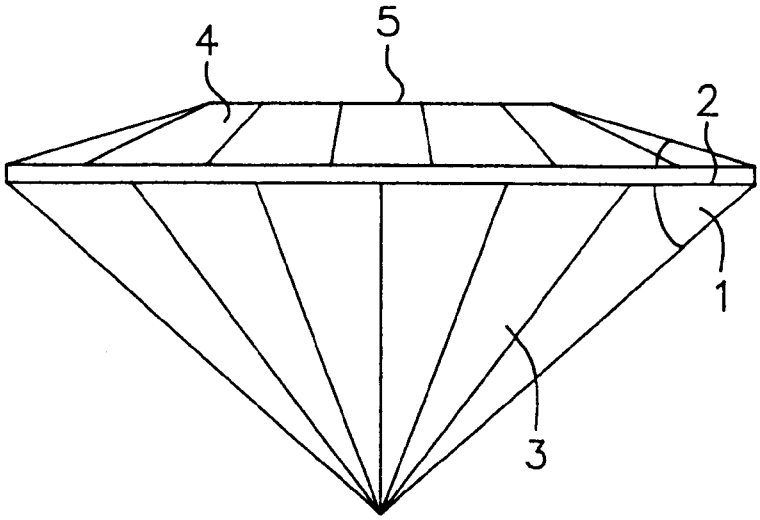
Figure 12C:
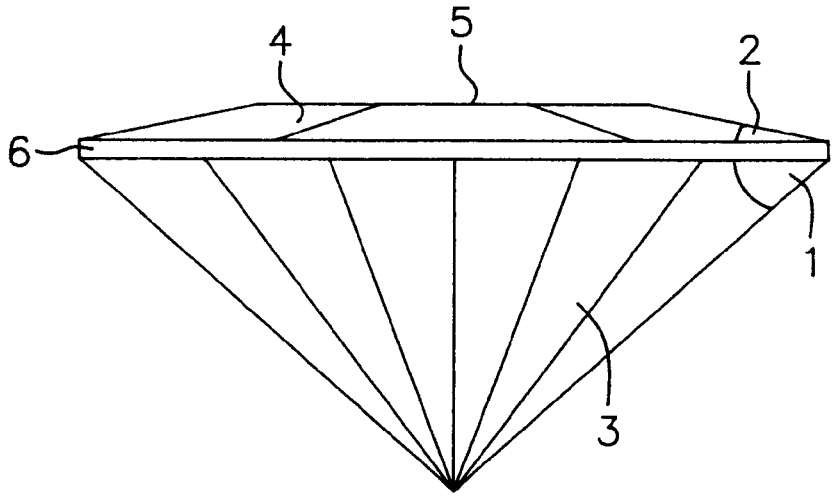
Figure 12D:
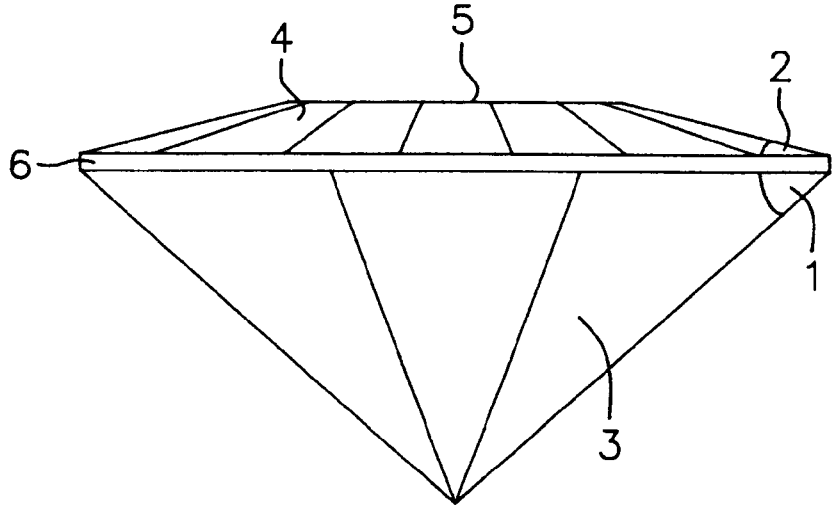

FIG. 10 schematically presents cuts in which girdles 6 are made of a round ring-shaped surface positioned between principal pavilion facets 3 and principal crown facets 4.

Principal pavilion facet angles 1 range from 41° to 46° and, depending on optical refraction n, principal crown facet angles 2 correspond to an angle from the group of preferred angles. Left column (a) includes cuts without table; for cuts shown in the middle of the page (b), the diameter of table 5 is about 50% of the diameter of girdle 6. A gem with a principal crown facet angle of 0° (c) is shown on the right side of the page. In this case, principal crown facets 4 coincide with table 5 and the girdle surface.

FIG. 11 shows various shapes of the girdle. It may consist of a rounded surface (a) or of a number of flat facets 7 (b, d, e).Thereby, girdle facets 7 may have different heights H, they may be arranged at an angle of 90° to the girdle surface (b, d), or they may form with it an angle differing from 90° (e). FIG. 11 (*c*) shows a cut in which principal crown facets 4 and principal pavilion facets 3 create a joint edge. Thus, girdle 6 may consist of a single line.

FIG. 12 shows various divisions of principal crown facets 4 and principal pavilion facets 3. Thereby, when equally divided, the facet edges may adjoin each other (a) on the girdle or may be mutually offset (b). The number of principal crown facets 4 may be smaller than the number of principal pavilion facets 3 (c) or vice versa (d).

Figure 13A:
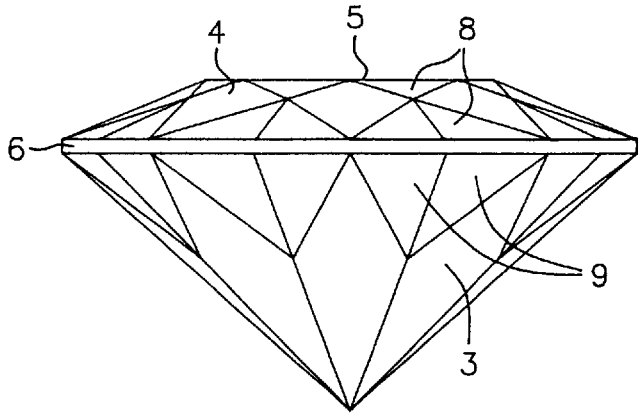
Figure 13B:
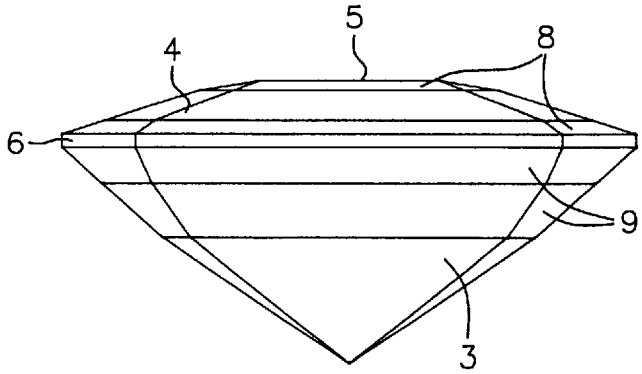
Figure 13C:
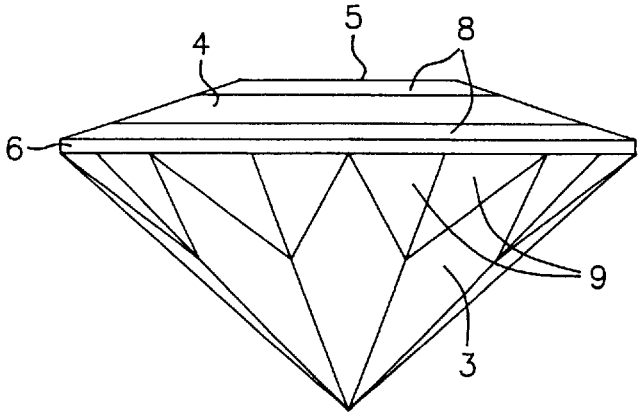

FIG. 13 shows cuts having, in addition to principal facets 3, 4 also dependent crown facets 8 and dependent pavilion facets 9.

In case of several facet types, the principal pavilion facets selected in this example should be considered to be the larger facets extending from the tip to the girdle (FIG. 13*a*), or those constitute the lowest facet row and converging at the tip (FIG. 13*b*).

In case of several facet types, the principal crown facets selected in this example should be considered to be the larger facets, extending from the girdle to the table (FIG. 1*a*), or the larger facets which constitute the center facet row in case of three facet rows (FIG. 13*b, c*).

FIG. 13(*a*) shows a brilliant cut, FIG. 13(*b*) a stepped cut. In FIG. 13(*c*) principal crown facets 4, 8 are laid out in a ring shape, in the form of conical reflection trajectories.

TABLE 1

Summary of preferred and especially preferred principal crown facet angles (OHFW) as a function of light refraction n and of the principal pavilion facet angles (UHFW)

| | | preferred principal crown facet angles (OHFW) | | |
|---|---|---|---|---|
| | UHFW | | especially preferred principal crown facet angles (OHFW) | |
| n 1,50 | 41° | | | |
| | 42° | 13,14,15, | 16,17,18,19,20,21, 22,23,24,25, | 26,27,28,29,30,31, 32,33, |
| | 43° | 6,7,8,9, | 10,11,12,13,14,15, 16,17,18,19,20,21, | 22,23,24,25,26 |
| | 44° | 1,2, | 3,4,5,6,7,8,9,10,11, 12,13,14,15,16, | 17,18, |
| | 45° | | 0,1,2,3,4,5,6,7,8,9, | |
| | 46° | 0 | | |
| n 1,55 | 41° | 18,19, | 20,21,22,23,24,25, 26, | 27,28,29,30,31,32, 33, |
| | 42° | 12,13,14, | 15,16,17,18,19,20, 21,22,23, | 24,25,26,27,28,29, 30, |
| | 43° | 6,7,8, | 9,10,11,12,13,14, 15,16,17,18,19, | 20,21,22,23,24,25, 26, |
| | 44° | 1,2, | 3,4,5,6,7,8,9,10, 11,12,13,14,15,16, | 17,18, |
| | 45° | | 0,1,2,3,4,5,6,7,8, | 9,10,11,12,13, |
| | 46° | 0,1,2,3,4, 5, | | |
| n 1,60 | 41° | 17,18, | 19,20,21,22,23,24, 25, | 26,27,26,29,30,31, |
| | 42° | 11,12,13, | 14,15,16,17,18,19, 20,21, | 22,23,24,25,26,27, 28, |
| | 43° | 6,7, | 8,9,10,11,13,14,15, 16,17, | 18,19,20,21,22,23, |
| | 44° | 1 | 2,3,4,5,6,7,8,9,10, 11,12, | 13,14,15,16,17,18, 19,20, |
| | 45° | | 0,1,2,3,4,5,6, | 8,9,10,11,12,13,14, |
| | 46° | | 0 | 1,2,3,4,5,6, |
| n 1,65 | 41° | 16,17,18, | 19,20,21,22,23, | 24,25,26,27,28, |
| | 42° | 11,12, | 13,14,15,16,17, 18,19,20, | 21,22,23,24,25, |
| | 43° | 5,6,7, | 8,9,10,11,12,13,14, 15, | 16,17,18,19,20,21, |
| | 44° | | 2,3,4,5,6,7,8,9,10, 11, | 11,13,14,15,16,17, |
| | 45° | 1 | 0,1,2,3,4,5,6, | 7,8,9,10,11,12,13, 14, |
| | 46° | | 0 | 1,2,3,4,5,6, |
| n 1,70 | 41° | 15,16,17 | 18,19,20,21, | 22,23,24,25,26,27, |
| | 42° | 10,11, | 12,13,14,15,16,17, 18, | 19,20,21,22,23. |
| | 43° | 5,6, | 7,8,9,10,11,12,13, 14, | 15,16,17,18,19,20, |
| | 44° | 1 | 2,3,4,5,6,7,8,9,10, 11, | 12,13,14,15,16,17, |
| | 45° | | 0,1,2,3,4,5,6, | 7,8,9,10,11,12, |
| | 46° | | 0 | 1,2,3,4,5,6, |
| n 1,75 | 41° | 15,16, | 17,18,19,20,21, | 22,23,24,25, |
| | 42° | 10,11, | 12,13,14,15,16, | 17,18,19,20,21,22, |
| | 43° | 5,6, | 7,8,9,10,11,12,13, | 14,15,16,17,18,19, |
| | 44° | 1 | 2,3,4,5,6,7,8,9,10, 11, | 12,13,14,15, |
| | 45° | | 0,1,2,3,4,5,6, | 7,8,9,10,11,12, |
| | 44° | | 0,1, | 2,3, |

TABLE 1-continued

Summary of preferred and especially preferred principal crown facet angles (OHFW) as a function of light refraction n and of the principal pavilion facet angles (UHFW)

| | UHFW | preferred principal crown facet angles (OHFW) | | | especially preferred principal crown facet angles (OHFW) |
|---|---|---|---|---|---|
| n 1,80 | 41° | 14,15, | 16,17,18,19, | 20,21,22,23,24, | |
| | 42° | 10,11, | 12,13,14,15,16, | 17,18,19,20,21, | |
| | 43° | 5,6, | 7,8,9,10,11,12,13, | 14,15,16,17,18,19, | |
| | 44° | | 2,3,4,5,6,7,8,9,10, | 11,12,13,14, | |
| | 45° | | 0,1,2,3,4,5,6, | 7,8,9,10,11, | |
| | 46° | | 0,1, | 2,3, | |
| n 1,85 | 41° | 14,15, | 16,17,18, | 19,20,21,22,23, | |
| | 42° | 9,10, | 11,12,13,14,15, | 16,17,18,19,20, | |
| | 43° | 5 | 6,7,8,9,10,11,12, | 13,14,15,16,17, | |
| | 44° | | 2,3,4,5,6,7,8,9,10, | 11,12,13,14, | |
| | 45° | | 0,1,2,3,4,5,6, | 7,8,9,10,11, | |
| | 46° | | 0 | 1,2,3, | |
| n 1,90 | 41° | 14,15, | 16,17,18, | 19,20,21,22, | |
| | 42° | 9,10, | 11,12,13,14, | 15,16,17,18,19,20, | |
| | 43° | 5 | 6,7,8,9,10,11,12, | 13,14,15,16,17, | |
| | 44° | 1 | 2,3,4,5,6,7,8,9, | 10,11,12,13,14, | |
| | 45° | | 0,1,2,3,4,5,6, | 7,8,9, | |
| | 46° | | 0 | 1,2,3, | |
| n 1,95 | 41° | 13,14, | 15,16,17, | 18,19,20,21,22, | |
| | 42° | 9,10, | 11,12,13,14, | 15,16,17,18,19,20, | |
| | 43° | 5 | 6,7,8,9,10,11,12, | 13,14,15,16, | |
| | 44° | 1 | 2,3,4,5,6,7,8,9, | 10,11,12,13, | |
| | 45° | | 0,1,2,3,4,5,6, | 7,8,9, | |
| | 46° | | 0 | 1,2,3, | |
| n 2,00 | 41° | 13,14, | 15,16,17, | 18,19,20,21,22, | |
| | 42° | 8,9, | 10,11,12,13,14, | 15,16,17, | |
| | 43° | 4,5, | 6,7,8,9,10,11, | 12,13,14,15,16, | |
| | 44° | 1 | 2,3,4,5,6,7,8,9, | 10,11,12, | |
| | 45° | | 0,1,2,3,4,5,6, | 7,8,9, | |
| | 46° | | 0 | 1,2,3, | |
| n 2,05 | 41° | 13,14, | 15,16,17, | 18,19, | |
| | 42° | 8,9, | 10,11,12,13,14, | 15,16, | |
| | 43° | 4,5, | 6,7,8,9,10,11, | 12,13,14, | |
| | 44° | 1 | 2,3,4,5,6,7,8,9, | 10,11,12, | |
| | 45° | | 0,1,2,3,4,5,6, | 7,8,9, | |
| | 46° | | 0 | 1,2,3, | |
| n 2,10 | 41° | 12,13, | 14,15,16, | 17,18,19, | |
| | 42° | 8,9, | 10,11,12,13,14, | 15,16, | |
| | 43° | 4,5, | 6,7,8,9,10,11, | 12,13,14, | |
| | 44° | 1 | 2,3,4,5,6,7,8,9, | 10,11,12, | |
| | 45° | | 0,1,2,3,4,5,6, | 7,8, | |
| | 46° | | 0 | 1,2,3, | |
| n 2,15 | 41° | 12,13, | 14,15,16, | 17,18, | |
| | 42° | 8,9, | 10,11,12,13, | 14,15,16, | |
| | 43° | 4 | 5,6,7,8,9,10,11, | 12,13,14, | |
| | 44° | 1 | 2,3,4,5,6,7,6,9, | 10,11 | |
| | 45° | | 0,1,2,3,4,5,6, | 7,8, | |
| | 46° | | 0 | 1,2,3,4, | |
| n 2,20 | 41° | 12,13, | 14,15, | 16,17,18, | |
| | 42° | 8,9, | 10,11,12,13, | 14,15 | |
| | 43° | 4 | 5,6,7,8,9,10,11, | 12,13, | |
| | 44° | 1 | 2,3,4,5,6,7,8, | 9,10, | |
| | 45° | | 0,1,2,3,4,5, | 6,7,8 | |
| | 46° | | 0 | 1,2,3,4, | |
| n 2,25 | 41° | 12,13, | 14,16, | 16,17, | |
| | 42° | 8,9, | 10,11,12,13, | 14,15, | |
| | 43° | 4 | 5,6,7,8,9,10,11, | 12,13, | |
| | 44° | 1 | 4,5,6,7,8, | 9,10, | |
| | 45° | | 0,1,2,3,4,5, | 6,7,8, | |
| | 46° | | 0 | 1,2,3, | |
| n 2,30 | 41° | 12,13, | 14,15, | 16,17, | |
| | 42° | 7,8, | 9,10,11,12,13, | 14,15, | |
| | 43° | 4 | 5,6,7,8,9,10, | 11,12,13, | |
| | 44° | 1 | 2,3,4,5,6,7,8, | 9,10, | |
| | 45° | | 0,1,2,3,4,5, | 6,7, | |
| | 46° | | 0 | 1,2,3, | |
| n 2,35 | 41° | 11,12, | 13,14,15, | 16,17, | |
| | 42° | 7,8, | 9,10,11,12, | 13,14, | |

TABLE 1-continued

Summary of preferred and especially preferred principal crown facet angles (OHFW) as a function of light refraction n and of the principal pavilion facet angles (UHFW)

| | UHFW | preferred principal crown facet angles (OHFW) | | | especially preferred principal crown facet angles (OHFW) |
|---|---|---|---|---|---|
| | 43° | 4 | 5,6,7,8,9,10, | 11,12, | |
| | 44° | 1 | 2,3,4.5,6,7, | 8,9,10, | |
| | 45° | | 0,1,2,3,4,5, | 6,7, | |
| | 46° | | 0 | 1,2,3, | |
| n 2,40 | 41° | 11,12, | 13,14, | 15,16, | |
| | 42° | 7,8, | 9,10,11,12, | 13,14, | |
| | 43° | 4 | 5,6,7,8,9, | 10,11,12, | |
| | 44° | 1 | 2,3,4,5,6,7, | 8,9,10, | |
| | 45° | | 0,1,2,3,4. | 5,6,7, | |
| | 46° | | 0 | 1,2,3, | |
| n 2,45 | 41° | | | | |
| | 42° | 7,8, | 9,10,11, | 12,13,14, | |
| | 43° | 4 | 5,6,7,8,9, | 10,11,12, | |
| | 44° | 1 | 2,3,4,5,6,7, | 8,9,10, | |
| | 45° | | 0,1,2,3,4, | 5,6,7, | |
| | 46° | | 0 | 1,2,3, | |
| n 2,50 | 41° | 11,12, | 13 | 14,15,16, | |
| | 42° | 7,8, | 9,10,11, | 12,13,14, | |
| | 43° | 4 | 5,6,7,8,9, | 10,11, | |
| | 44° | 1 | 2,3,4,5,6,7, | 8,9, | |
| | 45° | | 0,1,2,3,4, | 5,6,7, | |
| | 46° | 0,1,2, | | | |
| n 2,55 | 41° | 11,12, | 13,14, | 15,18, | |
| | 42° | 7,8, | 9,10,11, | 12,13,14, | |
| | 43° | 4 | 5,6,7,8,9, | 10,11,12, | |
| | 44° | 1 | 2,3,4,5,6,7, | 8,9,10, | |
| | 45° | | 0,1,2,3,4, | 5,6,7, | |
| | 46° | | 0 | 1,2,3, | |
| n 2,60 | 41° | 11,12, | 13 | 14,15, | |
| | 42° | 7,8, | 9,10,11, | 12,13, | |
| | 43° | 4 | 5,6,7,8,9, | 10,11, | |
| | 44° | 1 | 2,3,4,5,6,7, | 8,9, | |
| | 45° | | 0,1,2,3, | 4,5,6,7, | |
| | 46° | 0,1,2, | | | |
| n 2,65 | 41° | 10,11,12, | | | |
| | | 13,14,15, | | | |
| | 42° | 7,8, | 9,10, | 11,12,13, | |
| | 43° | 4 | 5,6,7,8,9, | 10,11, | |
| | 44° | 1 | 2,3,4,5,6, | 7,8,9, | |
| | 45° | | 0,1,2,3, | 4,5,6, | |
| | 46° | 0,1,2, | | | |
| n 2,70 | 41° | 10,11,12, | | | |
| | | 13,14,15, | | | |
| | 42° | 7,8, | 9,10, | 11,12,13, | |
| | 43° | 4 | 5,6,7,8,9, | 10,11, | |
| | 44° | 1 | 2,3,4,5,6, | 7,8,9, | |
| | 45° | | 0,1,2,3, | 4,5,6, | |
| | 46° | 0,1,2, | | | |
| n 2,75 | 41° | 10,11,12, | | | |
| | | 13,14,15, | | | |
| | 42° | 7,8, | 9,10, | 11,12, | |
| | 43° | 4 | 5,6,7,8, | 9,10,11, | |
| | 44° | 1 | 2,3,4,5,6, | 7,8,9, | |
| | 45° | | 0,1,2,3, | 4,5,6, | |
| | 46° | 0,1, | | | |
| n 2,80 | 41° | 10,11,12, | | | |
| | | 13,14,15, | | | |
| | 42° | 7,8, | 9,10, | 11,12, | |
| | 43° | 4 | 5,6,7,8, | 9,10, | |
| | 44° | 1 | 2,3,4,5,6, | 7,8, | |
| | 45° | | 0,1,2,3, | 4,5,6, | |
| | 46° | 0,1, | | | |
| n 2,85 | 41° | 10,11,12, | | | |
| | | 13,14, | | | |
| | 42° | 7,8, | 9 | 10,11,12, | |
| | 43° | 4 | 5,6,7,8, | 9,10, | |
| | 44° | 1 | 2,3,4,5,6, | 7,8, | |

TABLE 1-continued

Summary of preferred and especially preferred principal crown facet angles (OHFW) as a function of light refraction n and of the principal pavilion facet angles (UHFW)

| | UHFW | preferred principal crown facet angles (OHFW) | | especially preferred principal crown facet angles (OHFW) |
|---|---|---|---|---|
| | 45° | | 0,1,2,3, | 4,5,6, |
| | 46° | 0,1, | | |
| n 2,90 | 41° | 10,11,12, 13,14, | | |
| | 42° | 7,8, | 9 | 10,11,12, |
| | 43° | 4 | 5,6,7,8, | 9,10, |
| | 44° | 1 | 2,3,4,5,6, | 7,8, |
| | 45° | | 0,1,2,3, | 4,5,6, |
| | 46° | 0,1, | | |
| n 2,95 | 41° | 10,11,12, 13,14, | | |
| | 42° | 7 | 8,9, | 10,11,12, |
| | 43° | 4 | 5,6,7,8, | 9,10, |
| | 44° | 1 | 2,3,4,5,6, | 7,8, |
| | 45° | | 0,1,2,3, | 4,5,6, |
| | 46° | | | |
| n 3,00 | 41° | 10,11,12, 13,14, | | |
| | 42° | 7 | 8,9, | 10,11,12, |
| | 43° | 4 | 5,6,7,8, | 9,10, |
| | 44° | 1 | 2,3,4,5,6, | 7,8, |
| | 45° | | 0,1,2,3, | 4,5,6, |
| | 46° | 0,1, | | |

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A cut gem including high reflection with at least three principal pavilion facets and at least three principal crown facets, an angle between the principal pavilion facets and a girdle surface being greater than an angle between the principal crown facets and the girdle surface, such that at angle 0° a table is formed instead of the principal crown facets, with principal pavilion facet angle (UHFW) ranging between 41° and 46° and principal crown facet angle (ORFW) corresponding to an angle selected from a group of predetermined, preferred angles, which are subject to mean optical refraction n ranging between 1.50 and 3.00 of a raw material to be cut, and principal pavilion facet angle (UHFW), said group of predetermined, preferred angles comprising the following angles:

at n 1.50 and UHFW of 42°⇒angles of 13° to 33°
at n 1.50 and UHFW of 43°⇒angles of 6° to 26°
at n 1.50 and UHFW of 44°⇒angles of 1° to 18°
at n 1.50 and UHFW of 45°⇒angles of 0° to 9°
at n 1.50 and UHFW of 46°⇒angles of 0°
at n 1.55 and UHFW of 41°⇒angles of 18° to 33°
at n 1.55 and UHFW of 42°⇒angles of 12° to 30°
at n 1.55 and UHFW of 43°⇒angles of 6° to 26°
at n 1.55 and UHFW of 44°⇒angles of 1° to 18°
at n 1.55 and UHFW of 45°⇒angles of 0° to 13°
at n 1.55 and UHPW of 46°⇒angles of 0° to 5°
at n 1.60 and UHFW of 41°⇒angles of 17° to 31°
at n 1.60 and UHFW of 42°⇒angles of 11° to 28°
at n 1.60 and UHEW of 43°⇒angles of 6° to 23°
at n 1.60 and UHFW of 44°⇒angles of 1° to 20°
at n 1.60 and UHFW of 45°⇒angles of 0° to 14°
at n 1.60 and UHFW of 46°⇒angles of 0° to 6°
at n 1.65 and UHFW of 41°⇒angles of 16° to 28°
at n 1.65 and UHFW of 42°⇒angles of 11° to 25°
at n 1.65 and UHFW of 43°⇒angles of 5° to 21°
at n 1.65 and UHFW of 44°⇒angles of 1° to 17°
at n 1.65 and UHFW of 45°⇒angles of 0° to 14°
at n 1.65 and UHFW of 46°⇒angles of 0° to 6°
at n 1.70 and UHFW of 41°⇒angles of 15° to 27°
at n 1.70 and UHFW of 42°⇒angles of 10° to 23°
at n 1.70 and UHFW of 43°⇒angles of 5° to 20°
at n 1.70 and UHFW of 44°⇒angles of 1°to 17°
at n 1.70 and UHFW of 45°⇒angles of 0° to 12°
at n 1.70 and UHFW of 46°⇒angles of 0° to 6°
at n 1.75 and UHFW of 41°⇒angles of 15° to 25°
at n 1.75 and UHFW of 42°⇒angles of 10° to 22°
at n 1.75 and UHFW of 43°⇒angles of 5° to 19°
at n 1.75 and UHFW of 44°⇒angles of 1°to 15°
at n 1.75 and UHFW of 45°⇒angles of 0° to 12°
at n 1.75 and UHFW of 46°⇒angles of 0° to 3°
at n 1.80 and UHFW of 41°⇒angles of 14° to 24°
at n 1.80 and UHFW of 42°⇒angles of 1° to 21°
at n 1.80 and UHFW of 43°⇒angles of 5° to 19°
at n 1.80 and UHFW of 44°⇒angles of 1° to 14°
at n 1.80 and UHFW of 45°⇒angles of 0° to 11°
at n 1.80 and UHFW of 46°⇒angles of 0° to 3°
at n 1.85 and UHFW of 41°⇒angles of 14° to 23°
at n 1.85 and UHFW of 42°⇒angles of 9° to 20°
at n 1.85 and UHFW of 43°⇒angles of 5° to 17°
at n 1.85 and UHFW of 44°⇒angles of 1° to 14°
at n 1.85 and UHFW of 45°⇒angles of 0° to 11°
at n 1.85 and UHFW of 46°⇒angles of 0° to 3°
at n 1.90 and UHFW of 41°⇒angles of 14° to 22°
at n 1.90 and UHFW of 42°⇒angles of 9° to 20°
at n 1.90 and UHFW of 43°⇒angles of 5° to 17°
at n 1.90 and UHFW of 44°⇒angles of 1° to 14°
at n 1.90 and UHFW of 45°⇒angles of 0° to 9°
at n 1.90 and UHFW of 46°⇒angles of 0° to 3°
at n 1.95 and UHFW of 41°⇒angles of 13° to 22°
at n 1.95 and UHFW of 42°⇒angles of 9° to 20°
at n 1.95 and UHFW or 43°⇒angles of 5° to 16°
at n 1.95 and UHFW of 44°⇒angles of 1° to 13°
at n 1.95 and UHFW of 45°⇒angles of 0° to 9°
at n 1.95 and UHFW of 46°⇒angles of 0° to 3°
at n 2.00 and UHFW of 41°⇒angles of 13° to 22°
at n 2.00 and UHFW of 42°⇒angles of 8° to 17°
at n 2.00 and UHFW of 43°⇒angles of 4° to 16°
at n 2.00 and UHFW of 44°⇒angles of 1° to 12°
at n 2.00 and UHFW of 45°⇒angles of 0° to 9°
at n 2.00 and UHFW of 46°⇒angles of 0° to 3°
at n 2.05 and UHFW of 41°⇒angles of 13° to 19°
at n 2.05 and UHFW of 42°⇒angles of 8° to 16°
at n 2.05 and UHFW of 43°⇒angles of 4° to 14° at n 2.05 and UHFW of 44°⇒angles of 1° to 12°
at n 2.05 and UHFW of 45°⇒angles of 0° to 9°
at n 2.05 and UHFW of 46°⇒angles of 0° to 3°
at n 2.10 and UHFW of 41°⇒angles of 12° to 19°
at n 2.10 and UHFW of 42°⇒angles of 8° to 16°
at n 2.10 and UHFW of 43°⇒angles of 4° to 14°
at n 2.10 and UHFW of 44°⇒angles of 1° to 12°
at n 2.10 and UHFW of 45°⇒angles of 0° to 8°
at n 2.10 and UHFW of 46°⇒angles of 0° to 3°
at n 2.15 and UHFW of 41°⇒angles of 12° to 18°
at n 2.15 and UHFW of 42°⇒angles of 8° to 16°
at n 2.15 and UHFW of 43°⇒angles of 4° to 14°
at n 2.15 and UHFW of 44°⇒angles of 1° to 11°
at n 2.15 and UHFW of 45°⇒angles of 0° to 8°
at n 2.15 and UHFW of 46°⇒angles of 0° to 4°
at n 2.20 and UHFW of 41°⇒angles of 12° to 18°
at n 2.20 and UHFW of 42°⇒angles of 8° to 15°
at n 2.20 and UHFW of 43°⇒angles of 4° to 13°
at n 2.20 and UHFW of 44°⇒angles of 1° to 10°
at n 2.20 and UHFW of 45°⇒angles of 0° to 8°
at n 2.20 and UHFW of 46°⇒angles of 0° to 4°
at n 2.25 and UHFW of 41°⇒angles of 12° to 17°
at n 2.25 and UHFW of 42°⇒angles of 8° to 15°
at n 2.25 and UHFW of 43°⇒angles of 4° to 13°
at n 2.25 and UHFW of 44°⇒angles of 1° to 10°
at n 2.25 and UHFW of 45°⇒angles of 0° to 8°
at n 2.25 and UHFW of 46°⇒angles of 0° to 3°
at n 2.30 and UHFW of 41°⇒angles of 12° to 17°
at n 2.30 and UHFW of 42°⇒angles of 7° to 15°
at n 2.30 and UHFW of 43°⇒angles of 4° to 13°
at n 2.30 and UHFW of 44°⇒angles of 1° to 10°
at n 2.30 and UHFW of 45°⇒angles of 0° to 7°
at n 2.30 and UHFW of 46°⇒angles of 0° to 3°
at n 2.35 and UHFW of 41°⇒angles of 11° to 17°
at n 2.35 and UHFW of 42°⇒angles of 7° to 14°
at n 2.35 and UHFW of 43°⇒angles of 4° to 12°
at n 2.35 and UHFW of 44°⇒angles of 1° to 10°
at n 2.35 and UHFW of 45°⇒angles of 0° to 7°
at n 2.35 and UHFW of 46°⇒angles of 0° to 3°
at n 2.40 and UHFW of 41°⇒angles of 11° to 16°
at n 2.40 and UHFW of 42°⇒angles of 7° to 14°
at n 2.40 and UHFW of 43°⇒angles of 4° to 12°
at n 2.40 and UHFW of 44°⇒angles of 1° to 10°
at n 2.40 and UHFW of 45°⇒angles of 0° to 7°
at n 2.40 and UHFW of 46°⇒angles of 0° to 3°
at n 2.45 and UHFW of 41°⇒angles of 11° to 16°
at n 2.45 and UHFW of 42°⇒angles of 7° to 14°
at n 2.45 and UHFW of 43°⇒angles of 4° to 12°
at n 2.45 and UHFW of 44°⇒angles of 1° to 10°
at n 2.45 and UHFW of 45°⇒angles of 0° to 7°
at n 2.45 and UHFW of 46°⇒angles of 0° to 3°
at n 2.50 and UHFW of 41°⇒angles of 11° to 16°
at n 2.50 and UHFW of 42°⇒angles of 7° to 14°
at n 2.50 and UHFW of 43°⇒angles of 4° to 11°
at n 2.50 and UHFW of 44°⇒angles of 1° to 9°
at n 2.50 and UHFW of 45°⇒angles of 0° to 7°
at n 2.50 and UHFW of 46°⇒angles of 0° to 3°
at n 2.55 and UHFW of 41°⇒angles of 11° to 15°
at n 2.55 and UHFW of 42°⇒angles of 7° to 13°
at n 2.55 and UHFW of 43°⇒angles of 4° to 11°
at n 2.55 and UHFW of 44°⇒angles of 1° to 9°
at n 2.55 and UHFW of 45°⇒angles of 0° to 7°
at n 2.55 and UHFW of 46°⇒angles of 0° to 2°
at n 2.60 and UHFW of 41°⇒angles of 11° to 15°
at n 2.60 and UHFW of 42°⇒angles of 7° to 13°
at n 2.60 and UHFW of 43°⇒angles of 4° to 11°
at n 2.60 and UHFW of 44°⇒angles of 1° to 9°
at n 2.60 and UHFW of 45°⇒angles of 0° to 7°
at n 2.60 and UHFW of 46°⇒angles of 0° to 2°
at n 2.65 and UHFW of 41°⇒angles of 10° to 15°
at n 2.65 and UHFW of 42°⇒angles of 7° to 13°
at n 2.65 and UHFW of 43°⇒angles of 4° to 11°
at n 2.65 and UHFW of 44°⇒angles of 1° to 9°
at n 2.65 and UHFW of 45°⇒angles of 0° to 6°
at n 2.65 and UHFW of 46°⇒angles of 0° to 2°
at n 2.70 and UHFW of 41°⇒angles of 10° to 15°
at n 2.70 and UHFW of 42°⇒angles of 7° to 13°
at n 2.70 and UHFW of 43°⇒angles of 4° to 11°
at n 2.70 and UHFW of 44°⇒angles of 1° to 9°
at n 2.70 and UHFW of 45°⇒angles of 0° to 6°
at n 2.70 and UHFW of 46°⇒angles of 0° to 2°
at n 2.75 and UHFW of 41°⇒angles of 10° to 15°
at n 2.75 and UHFW of 42°⇒angles of 7° to 12°
at n 2.75 and UHFW of 43°⇒angles of 4° to 11°
at n 2.75 and UHFW of 44°⇒angles of 1° to 9°
at n 2.75 and UHFW of 45°⇒angles of 0° to 6°
at n 2.75 and UHFW of 46°⇒angles of 0° to 1°
at n 2.80 and UHFW of 41°⇒angles of 10° to 15°
at n 2.80 and UHFW of 42°⇒angles of 7° to 12°
at n 2.80 and UHFW of 43°⇒angles of 4° to 10°
at n 2.80 and UHFW of 44°⇒angles of 1° to 8°
at n 2.80 and UHFW of 45°⇒angles of 0° to 6°
at n 2.80 and UHFW of 46°⇒angles of 0° to 1°
at n 2.85 and UHFW of 41°⇒angles of 10° to 14°
at n 2.85 and UHFW of 42°⇒angles of 7° to 12°
at n 2.85 and UHFW of 43°⇒angles of 4° to 10°
at n 2.85 and UHFW of 44°⇒angles of 1° to 8°
at n 2.85 and UHFW of 45°⇒angles of 0° to 6°
at n 2.85 and UHFW of 46°⇒angles of 0° to 1°
at n 2.90 and UHFW of 41°⇒angles of 10° to 14°
at n 2.90 and UHFW of 42°⇒angles of 7° to 12°
at n 2.90 and UHFW of 43°⇒angles of 4° to 10°
at n 2.90 and UHFW of 44°⇒angles of 1° to 8°
at n 2.90 and UHFW of 45°⇒angles of 0° to 6°
at n 2.90 and UHFW of 46°⇒angles of 0° to 1°
at n 2.95 and UHFW of 41°⇒angles of 10° to 14°
at n 2.95 and UHFW of 42°⇒angles of 7° to 12°
at n 2.95 and UHFW of 43°⇒angles of 4° to 10°
at n 2.95 and UHFW of 44°⇒angles of 1° to 8°
at n 2.95 and UHFW of 45°⇒angles of 0° to 6°
at n 2.95 and UHFW of 46°⇒angles of 0° to 1°
at n 3.00 and UHFW of 41°⇒angles of 10° to 14° at n 3.00 and UHFW of 42°⇒angles of 7° to 12°
at n 3.00 and UHFW of 43°⇒angles of 4° to 10°
at n 3.00 and UHFW of 44°⇒angles of 1° to 8°
at n 3.00 and UHFW of 45°⇒angles of 0° to 6°
at n 3.00 and UHFW of 46°⇒angles of 0° to 1° and principal crown facet angles (OHFW) for values of n and principal pavilion facet angles (UHFW) not specifically specified above being derived by interpolation from the above specified values.

2. The cut gem according to claim 1, wherein, in addition to a number of principal crown facets, the gem has a table of a diameter which preferably amounts to 0 to 85% of a diameter of the girdle surface.

3. The gem cut according to claim 1, wherein for a diamond the group of preferred principal crown facet angles (OHFW) comprises the following angles:

with UHFW of 41° ⇒angles of 11° to
with UHFW of 42° ⇒angles of 7° to 14°
with UHFW of 43° ⇒angles of 4° to 12°
with UHFW of 44° ⇒angles of 1° to 10°
with UHFW of 45° ⇒angles of 0° to 7°
with UHFW of 46° ⇒angles of 0° to 3°.

4. The cut gem according to claim 1, wherein within the group of preferred angles from which the principal crown facet angle is selected is a group of especially preferred principal crown facet angles (OHFW) comprising the following angles:

with UHFW of 41° ⇒of 13° to 14°
with UHFW of 42° ⇒of 9° to 12°
with UHFW of 43° ⇒of 5° to 9°
with UHFW of 44° ⇒of 2° to 7°
with UHFW of 45° ⇒of 0° to 4°
with UHFW of 46° ⇒of 0°.

5. The cut gem according to claim 4, said gem further comprising dependent crown facets, wherein the principal crown facets have an angle selected from the group of especially preferred principal crown facet angles (OHFW) and the dependent crown facets have an angle selected from the group of preferred angles.

6. The cut gem according to claim 1, wherein the raw material used for cutting is either a natural stone or synthetic material.

7. The cut gem according to claim 1, wherein, in addition to principal pavilion facets (UHFW)and principal crown facets (OHFW), the gem has at least one of additional dependent pavilion facets and dependent crown facets.

8. The cut gem according to claim 1, wherein at least one of the number of pavilion facets and the number of crown facets is an even number.

9. The cut gem according to claim 8, wherein said even number is greater than 13.

10. The cut gem according to claim 1, wherein at least one of the number of pavilion facets and the number of crown facets is an odd number and is greater than 13.

11. The cut gem according to claim 1, wherein the number of principal crown facets and/or principal pavilion facets may be even or odd and edges between the principal pavilion facets and the principal crown facets are mutually offset on the girdle surface.

12. The cut gem according to claim 1, wherein the girdle surface may be of any shape, and is either formed as an edge between the pavilion facets and the crown facets, or consists of at least one rounded or flat facet of any height.

13. The cut gem according to claim 1, wherein the gem is either manually or automatically cut.

14. The cut gem according to claim 1, wherein at least one of the number of pavilion facets and the number of crown facets is an odd number.

15. A cut gem including high reflection with at least three principal pavilion facets and at least three principal crown facets, an angle between the principal pavilion facets and a girdle surface being greater than an angle between the principal crown facets and the girdle surface, such that at angle 0° a table is formed instead of the principal crown facets, with principal pavilion facet angle (UHFW) ranging between 41° and 46° and principal crown facet angle (OHFW) corresponding to an angle selected from a group of predetermined, preferred angles, which are subject to mean optical refraction n ranging between 1.50 and 3.00 of a raw material to be cut, and principal pavilion facet angle (UHFW), said group of predetermined, preferred angles comprising the following angles:

at n 1.50 and UHFW of 42°⇒angles of 16° to 25°
at n 1.50 and UHFW of 43°⇒angles of 10° to 21°
at n 1.50 and UHFW of 44°⇒angles of 3° to 16°
at n 1.50 and UHFW of 45°⇒angles of 0° to 9°
at n 1.55 and UHFW of 41°⇒angles of 20° to 26°
at n 1.55 and UHFW of 42°⇒angles of 15° to 23°
at n 1.55 and UHFW of 43°⇒angles of 9° to 19°
at n 1.55 and UHFW of 44°⇒angles of 3° to 16°
at n 1.55 and UHFW of 45°⇒angles of 0° to 8°
at n 1.60 and UHFW of 41°⇒angles of 19° to 25°
at n 1.60 and UHFW of 42°⇒angles of 14° to 21°
at n 1.60 and UHFW of 43°⇒angles of 8° to 17°
at n 1.60 and UHFW of 44°⇒angles of 2° to 12°
at n 1.60 and UHFW of 45°⇒angles of 0° to 7°
at n 1.60 and UHFW of 46°⇒angles of 0°
at n 1.65 and UHFW of 41°⇒angles of 19° to 23°
at n 1.65 and UHFW of 42°⇒angles of 13° to 20°
at n 1.65 and UHFW of 43°⇒angles of 8° to 15°
at n 1.65 and UHFW of 44°⇒angles of 2° to 11°
at n 1.65 and UHFW of 45°⇒angles of 0° to 6°
at n 1.65 and UHFW of 46°⇒angles of 0°
at n 1.70 and UHFW of 41°⇒angles of 18° to 21°
at n 1.70 and UHFW of 42°⇒angles of 12° to 18°
at n 1.70 and UHFW of 43°⇒angles of 7° to 14°
at n 1.70 and UHFW of 44°⇒angles of 2° to 11°
at n 1.70 and UHFW of 45°⇒angles of 0° to 6°
at n 1.70 and UHFW of 46°⇒angles of 0°
at n 1.75 and UHFW of 41°⇒angles of 17° to 21°
at n 1.75 and UHFW of 42°⇒angles of 12° to 16°
at n 1.75 and UHFW of 43°⇒angles of 7° to 13°
at n 1.75 and UHFW of 44°⇒angles of 2° to 11°
at n 1.75 and UHFW of 45°⇒angles of 0° to 6°
at n 1.75 and UHFW of 46°⇒angles of 0° to 1°
at n 1.80 and UHFW of 41°⇒angles of 16° to 19°
at n 1.80 and UHFW of 42°⇒angles of 12° to 16°
at n 1.80 and UHFW of 43°⇒angles of 7° to 13°
at n 1.80 and UHFW of 44°⇒angles of 2° to 10°
at n 1.80 and UHFW of 45°⇒angles of 0° to 6°
at n 1.80 and UHFW of 46°⇒angles of 0° to 1°
at n 1.85 and UHFW of 41°⇒angles of 16° to 18°
at n 1.85 and UHFW of 42°⇒angles of 11° to 15°
at n 1.85 and UHFW of 43°⇒angles of 6° to 12° at n 1.85 and UHFW of 44°⇒angles of 2° to 10°
at n 1.85 and UHFW of 45°⇒angles of 0° to 6°
at n 1.85 and UHFW of 46°⇒angles of 0°
at n 1.90 and UHFW of 41°⇒angles of 16° to 18°
at n 1.90 and UHFW of 42°⇒angles of 11° to 14°
at n 1.90 and UHFW of 43°⇒angles of 6° to 12°
at n 1.90 and UHFW of 44°⇒angles of 2° to 9°
at n 1.90 and UHFW of 45°⇒angles of 0° to 6°
at n 1.90 and UHFW of 46°⇒angles of 0°
at n 1.95 and UHFW of 41°⇒angles of 15° to 17°
at n 1.95 and UHFW of 42°⇒angles of 11° to 14°
at n 1.95 and UHFW of 43°⇒angles of 6° to 12°
at n 1.95 and UHFW of 44°⇒angles of 2° to 9°
at n 1.95 and UHFW of 45°⇒angles of 0° to 6°
at n 1.95 and UHFW of 46°⇒angles of 0°
at n 2.00 and UHFW of 41°⇒angles of 15° to 17°
at n 2.00 and UHFW of 42°⇒angles of 10° to 14°
at n 2.00 and UHFW of 43°⇒angles of 6° to 12°
at n 2.00 and UHFW of 44°⇒angles of 2° to 9°
at n 2.00 and UHFW of 45°⇒angles of 0° to 6°
at n 2.00 and UHFW of 46°⇒angles of 0°
at n 2.05 and UHFW of 41°⇒angles of 15° to 17°
at n 2.05 and UHFW of 42°⇒angles of 10° to 14°
at n 2.05 and UHFW of 43°⇒angles of 6° to 11°
at n 2.05 and UHFW of 44°⇒angles of 2° to 9°
at n 2.05 and UHFW of 45°⇒angles of 0° to 6°
at n 2.05 and UHFW of 46°⇒angles of 0°
at n 2.10 and UHFW of 41°⇒angles of 14° to 16°
at n 2.10 and UHFW of 42°⇒angles of 10° to 14°
at n 2.10 and UHFW of 43°⇒angles of 6° to 11°
at n 2.10 and UHFW of 44°⇒angles of 2° to 9°
at n 2.10 and UHFW of 45°⇒angles of 0° to 6°
at n 2.10 and UHFW of 46°⇒angles of 0°
at n 2.15 and UHFW of 41°⇒angles of 14° to 16°
at n 2.15 and UHFW of 42°⇒angles of 10° to 13°
at n 2.15 and UHFW of 43°⇒angles of 5° to 11°
at n 2.15 and UHFW of 44°⇒angles of 2° to 9°
at n 2.15 and UHFW of 45°⇒angles of 0° to 6°
at n 2.15 and UHFW of 46°⇒angles of 0°
at n 2.20 and UHFW of 41°⇒angles of 14° to 15°
at n 2.20 and UHFW of 42°⇒angles of 10° to 13°
at n 2.20 and UHFW of 43°⇒angles of 5° to 11°
at n 2.20 and UHFW of 44°⇒angles of 2° to 8°
at n 2.20 and UHFW of 45°⇒angles of 0° to 5°
at n 2.20 and UHFW of 46°⇒angles of 0°
at n 2.25 and UHFW of 41°⇒angles of 14° to 15°
at n 2.25 and UHFW of 42°⇒angles of 10° to 13°
at n 2.25 and UHFW of 43°⇒angles of 5° to 11°
at n 2.25 and UHFW of 44°⇒angles of 2° to 8°
at n 2.25 and UHFW of 45°⇒angles of 0° to 5°
at n 2.25 and UHFW of 46°⇒angles of 0°
at n 2.30 and UHFW of 41°⇒angles of 14° to 15°
at n 2.30 and UHFW of 42°⇒angles of 9° to 13°
at n 2.30 and UHFW of 43°⇒angles of 5° to 10°
at n 2.30 and UHFW of 44°⇒angles of 2° to 8°
at n 2.30 and UHFW of 45°⇒angles of 0° to 5°
at n 2.30 and UHFW of 46°⇒angles of 0°
at n 2.35 and UHFW of 41°⇒angles of 13° to 15°
at n 2.35 and UHFW of 42°⇒angles of 9° to 12°
at n 2.35 and UHFW of 43°⇒angles of 5° to 10°
at n 2.35 and UHFW of 44°⇒angles of 2° to 7°
at n 2.35 and UHFW of 45°⇒angles of 0° to 5°
at n 2.35 and UHFW of 46°⇒angles of 0°
at n 2.40 and UHFW of 41°⇒angles of 13° to 14°
at n 2.40 and UHFW of 42°⇒angles of 9° to 12°
at n 2.40 and UHFW of 43°⇒angles of 5° to 9°
at n 2.40 and UHFW of 44°⇒angles of 2° to 7°
at n 2.40 and UHFW of 45°⇒angles of 0° to 4°
at n 2.40 and UHEW of 46°⇒angles of 0°
at n 2.45 and UHFW of 41°⇒angles of 13° to 14°
at n 2.45 and UHFW of 42°⇒angles of 9° to 11°
at n 2.45 and UHFW of 43°⇒angles of 5° to 9°
at n 2.45 and UHFW of 44°⇒angles of 2° to 7°
at n 2.45 and UHFW of 45°⇒angles of 0° to 4°
at n 2.45 and UHFW of 46°⇒angles of 0°
at n 2.50 and UHFW of 41°⇒angles of 13°
at n 2.50 and UHFW of 42°⇒angles of 9° to 11°
at n 2.50 and UHFW of 43°⇒angles of 5° to 9°
at n 2.50 and UHFW of 44°⇒angles of 2° to 7°
at n 2.50 and UHFW of 45°⇒angles of 0° to 4°
at n 2.55 and UHFW of 41°⇒angles of 13°
at n 2.55 and UHFW of 42°⇒angles of 9° to 11°
at n 2.55 and UHFW of 43°⇒angles of 5° to 9°
at n 2.55 and UHFW of 44°⇒angles of 2° to 7°
at n 2.55 and UHFW of 45°⇒angles of 0° to 3°
at n 2.60 and UHFW of 41°⇒angles of 13°
at n 2.60 and UHFW of 42°⇒angles of 9° to 11°
at n 2.60 and UHFW of 43°⇒angles of 5° to 9°
at n 2.60 and UHFW of 44°⇒angles of 2° to 7°
at n 2.60 and UHFW of 45°⇒angles of 0° to 3°
at n 2.65 and UHFW of 42°⇒angles of 9° to 11°
at n 2.65 and UHFW of 43°⇒angles of 5° to 9°
at n 2.65 and UHFW of 44°⇒angles of 2° to 6°
at n 2.65 and UHFW of 45°⇒angles of 0° to 3°
at n 2.70 and UHFW of 42°⇒angles of 9° to 10°
at n 2.70 and UHFW of 43°⇒angles of 5° to 9°
at n 2.70 and UHFW of 44°⇒angles of 2° to 6°
at n 2.70 and UHFW of 45°⇒angles of 0° to 3°
at n 2.75 and UHFW of 42°⇒angles of 9° to 10°
at n 2.75 and UHFW of 43°⇒angles of 5° to 8°
at n 2.75 and UHFW of 44°⇒angles of 2° to 6°
at n 2.75 and UHFW of 45°⇒angles of 0° to 3°
at n 2.80 and UHFW of 42°⇒angles of 9° to 10°
at n 2.80 and UHFW of 43°⇒angles of 5° to 8°
at n 2.80 and UHFW of 44°⇒angles of 2° to 6°
at n 2.80 and UHFW of 45°⇒angles of 0° to 3°
at n 2.85 and UHFW of 42°⇒angles of 9°
at n 2.85 and UHFW of 43°⇒angles of 5° to 8°
at n 2.85 and UHFW of 44°⇒angles of 2° to 6°
at n 2.85 and UHFW of 45°⇒angles of 0° to 3°
at n 2.90 and UHFW of 42°⇒angles of 9°
at n 2.90 and UHFW of 43°⇒angles of 5° to 8° at n 2.90 and UHFW of 44°⇒angles of 2° to 6° at n 2.90 and UHFW of 45°⇒angles of 0° to 3° at n 2.95 and UHFW of 42°⇒angles of 8° to 9° at n 2.95 and UHFW of 43°⇒angles of 5° to 8° at n 2.95 and UHFW of 44°⇒angles of 2° to 6° at n 2.95 and UHFW of 45°⇒angles of 0° to 3° at n 3.00 and UHEW of 42°⇒angles of 8° to 9° at n 3.00 and UHFW of 43°⇒angles of 5° to 8° at n 3.00 and UHFW of 44°⇒angles of 2° to 6° at n 3.00 and UHFW of 45°⇒angles of 0° to 3° and principal crown facet angles (OHFW) for values of n and principal pavilion facet angles (UHFW) not specifically specified above being derived by interpolation from the above specified values.

16. The cut gem according to claim 15, wherein, in addition to a number of principal crown facets, the gem has a table of a diameter which preferably amounts to 0 to 85% of a diameter of the girdle surface.

17. The cut gem according to claim 15, wherein for a diamond the group of preferred principal crown facet angles (OHFW) comprises the following angles:

with UHFW of 41°⇒angles of 11° to with UHFW of 42°⇒angles of 7° to 14° with UHFW of 43°⇒angles of 4° to 12° with UHFW of 44°⇒angles of 1° to 10° with UHFW of 45°⇒angles of 0° to 7° with UHFW of 46°⇒angles of 0° to 3°.

18. The cut gem according to claim 15, wherein within the group of preferred angles from which the principal crown facet angle is selected is a group of especially preferred principal crown facet angles (OHFW) comprising the following angles:

with UHFW of 41°⇒angles of 13° to 14° with UHFW of 42°⇒angles of 9 to 12° with UHFW of 43°⇒angles of 5° to 9° with UHFW of 44°⇒angles of 2° to 7° with UHFW of 45°⇒angles of 0° to 4° with UHFW of 46°⇒angles of 0°.

19. The cut gem according to claim 18, said gem further comprising dependent crown facets, wherein the principal crown facets have an angle selected from the group of especially preferred principal crown facet angles (OHFW) and the dependent crown facets have an angle selected from the group of preferred angles.

20. The cut gem according to claim 15, wherein the raw material used for cutting is either a natural stone or synthetic material.

21. The cut gem according to claim 15, wherein, in addition to principal pavilion facets (UHFW)and principal crown facets (OHFW), the gem has at least one of additional dependent pavilion facets and dependent crown facets.

22. The cut gem according to claim 15, wherein at least one of the number of pavilion facets and the number of crown facets is an even number.

23. The cut gem according to claim 22, wherein said even number is greater than 13.

24. The cut gem according to claim 15, wherein at least one of the number of pavilion facets and the number of crown facets is an odd number.

25. The cut gem according to claim 24, wherein said odd number is greater than 13.

26. The cut gem according to claim 15, wherein the number of principal crown facets and/or principal pavilion facets may be even or odd and edges between the principal pavilion facets and the principal crown facets are mutually offset on the girdle surface.

27. The cut gem according to claim 15, wherein the girdle surface may be of any shape, and is either formed as an edge between the pavilion facets and the crown facets, or consists of at least one rounded or flat facet of any height.

28. The cut gem according to claim 15, wherein the gem is either manually or automatically cut.

* * * * *